US008704115B2

(12) United States Patent
Blakely

(10) Patent No.: US 8,704,115 B2
(45) Date of Patent: Apr. 22, 2014

(54) METAL DOME PRESSURE SWITCH

(71) Applicant: Stephen William Blakely, O'Fallon, MO (US)

(72) Inventor: Stephen William Blakely, O'Fallon, MO (US)

(73) Assignees: Snaptron, Inc., Windsor, CO (US); Rea Technologies, Inc., O'Fallon, MO (US)

( * ) Notice: Subject to any disclaimer, the term of this patent is extended or adjusted under 35 U.S.C. 154(b) by 0 days.

(21) Appl. No.: 13/842,233

(22) Filed: Mar. 15, 2013

(65) Prior Publication Data

US 2013/0248346 A1 Sep. 26, 2013

Related U.S. Application Data

(63) Continuation-in-part of application No. 13/053,793, filed on Mar. 22, 2011, now Pat. No. 8,558,127.

(60) Provisional application No. 61/316,309, filed on Mar. 22, 2010.

(51) Int. Cl.

| | |
|---|---|
| ***H01H 35/24*** | (2006.01) |
| ***H01H 35/26*** | (2006.01) |
| ***H01H 35/34*** | (2006.01) |

(52) U.S. Cl.
USPC ..... 200/83 R

(58) Field of Classification Search
USPC ..... 200/83 R, 81 R, 81.4, 81.9, 83 B, 61.22, 200/61.25, 406, 512, 513, 514, 515
See application file for complete search history.

(56) References Cited

U.S. PATENT DOCUMENTS

| | | | | |
|---|---|---|---|---|
| 3,908,105 | A * | 9/1975 | Schuler | 200/61.25 |
| 4,071,724 | A * | 1/1978 | Lejeune | 200/61.25 |
| 6,596,951 | B1 * | 7/2003 | Cusack | 200/83 P |

* cited by examiner

*Primary Examiner* — Edwin A. Leon
*Assistant Examiner* — Anthony R. Jimenez
(74) *Attorney, Agent, or Firm* — William W. Cochran; Cochran Freund & Young LLC

(57) ABSTRACT

Disclosed is a pressure switch that utilizes a dome switch having a flange surrounding the dome. The flange is anchored to a substrate such that the dome portion is in contact with a contact pad on the substrate. A pressure medium applied through passageways in the substrate flexes the dome in an elastic manner so that the dome does not contact the contact pad. When the pressure medium falls below a predetermined threshold level, the dome expands and contacts the contact pad to complete a circuit that indicates that the pressure of the pressure medium has fallen below the threshold level. Preloading force can be created between the dome and the contact pad to ensure a solid electrical connection. The preloading force can also be adjusted.

18 Claims, 24 Drawing Sheets

METAL DOME PRESSURE SWITCH

CROSS-REFERENCE TO RELATED APPLICATION

The present patent application is a continuation-in-part application of U.S. patent application Ser. No. 13/053,793, filed Mar. 22, 2011, by Stephen William Blakely, entitled "Metal Dome Pressure Switch," which application is based upon and claims the benefit of U.S. Provisional Patent Application Ser. No. 61/316,309, filed on Mar. 22, 2010, by Stephen William Blakely, entitled "Metal Dome Pressure Switch," which application is hereby specifically incorporated herein by reference for all that it discloses and teaches.

BACKGROUND OF THE INVENTION

Pressure switches exist in various configurations and operate in accordance with various techniques. Some pressure switches are quite complex and costly. Other pressure switches are less complex, less costly and are smaller in size.

SUMMARY OF THE INVENTION

An embodiment of the present invention may therefore comprise a pressure switch comprising: a substrate; a contact pad disposed on a first side of the substrate, the contact pad having a first predetermined shape; a dome switch comprising a dome having a predetermined diameter and a flange surrounding the dome, the flange anchored to the first side of the substrate with the dome pressed against the contact pad with a predetermined preload force that is sufficient to establish an electrical connection between the contact pad and the dome, the flange being anchored to the substrate so that an airtight seal is formed between the flange and the substrate and so that the predetermined diameter of the dome is substantially maintained during deflection of the dome, which substantially removes hysteresis caused by movement of the dome and causes the dome to move substantially elastically during deflection of the dome, the dome having a second predetermined shape that interfaces with the first predetermined; at least one passageway formed in the substrate that allows a pressurized medium on the second side of the substrate to flow through the substrate to the first side of the substrate which causes the dome to depress and separate from the contact pad and electrically disconnect from the contact pad whenever the pressurized medium is greater than a first predetermined pressure, and causes the dome to expand and electrically connect to the contact pad whenever the pressurized medium is less than a smaller second predetermined pressure.

An embodiment of the present invention may further comprise a pressure switch comprising: a housing; a platform disposed in the housing; a pressure switch insert disposed on the platform that divides a first compartment from a second compartment; a contact pad disposed on the pressure switch insert; a dome having a flange that is mounted on the pressure switch insert, the dome mounted on the pressure switch insert so that the dome abuts against the contact pad with a preloading force; an annulus disposed in the housing that generates a force on the flange to create at least a portion of the preloading force.

An embodiment of the present invention may further comprise a method of forming a pressure switch comprising: providing a pressure switch insert comprising a dome having a flange that surrounds the dome and a contact pad; mounting the pressure switch insert on a platform in a pressure switch housing; forcing the dome against the contact pad with a preload force that is sufficient to establish an electrical connection between the contact pad and the dome using a compression cylinder that generates a force on the flange.

DETAILED DESCRIPTION OF THE EMBODIMENTS

Figure 1A:
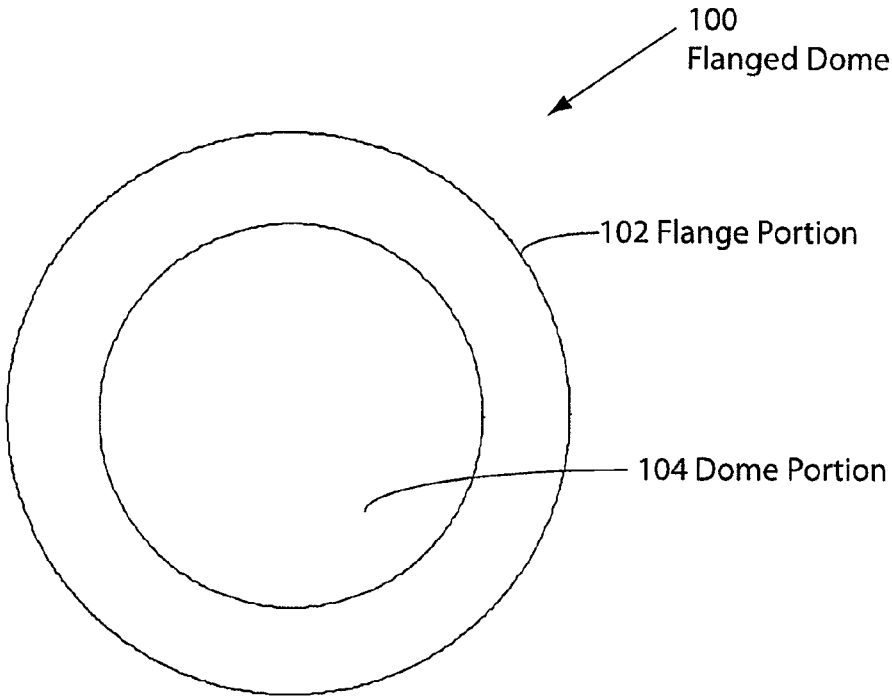
FIG. 1A is a top view of one embodiment of a flanged dome.

FIG. 1A is a top view of an embodiment of a flanged dome 100. As shown in FIG. 1, the flanged dome has a flange portion 102 and dome portion 104. Typically, the flanged dome 100 is made from a metal such as a stainless steel. The flange portion 102 may be coated with nickel, gold or silver to enhance the ability to solder the flange 102 to a printed circuit board as disclosed herein. The dome metal, such as stainless steel, from which the flanged dome 100 is constructed, may have different thicknesses that affect the dome elastic spring (resistance) properties. The particular type of metal used in the dome affects the modulus of elasticity of the dome. Various types of metals can be used, including nickel coated stainless steel, nickel coated copper alloys and uncoated copper alloys. In addition, the flanged dome, illustrated in FIG. 1, can be constructed in various sizes from several millimeters up to several centimeters, depending upon the size of the pressure switch in which the flanged dome is used. Since the flanged dome can be constructed in very small dimensions of only several millimeters, a pressure switch can be constructed as a very small device. For example, the flanged dome 100 can be used in a tire pressure monitor that screws onto a valve stem and emits an audible alarm whenever the pressure in the tire is either greater than, or less than, a predetermined pressure. The flange portion 102 assists in maintaining the circumference of the dome portion 104. In typical dome switches, there is no flange portion 102 to constrain the circumference of the dome portion 104. As such, when the dome portion 104 is physically compressed into a recessed position, the circumference of the dome portion 104 expands until the dome portion 104 snaps into an engaged position. The flange portion 102 assists in maintaining an elastic movement of the dome portion 104 as the dome portion 104 is compressed, which results in substantially no hysteresis in the movement of the dome portion 104. In that manner, a nearly identical force exists during both the depression and expansion of the dome 104.

Figure 1B:
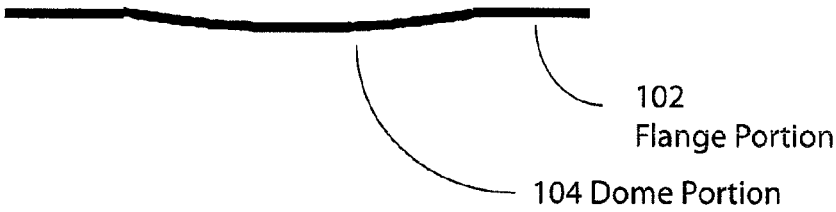
FIG. 1B is a side view of the embodiment of a flanged dome illustrated in FIG. 1.

FIG. 1B is a side sectional view of the embodiment of flanged dome 100 of FIG. 1A. As shown in FIG. 1B, the dome portion 104 extends outwardly from a plane established by the flange portion 102. As illustrated in FIG. 1B, dome portion 104 extends vertically downwardly from the flange portion 102.

Figure 2:
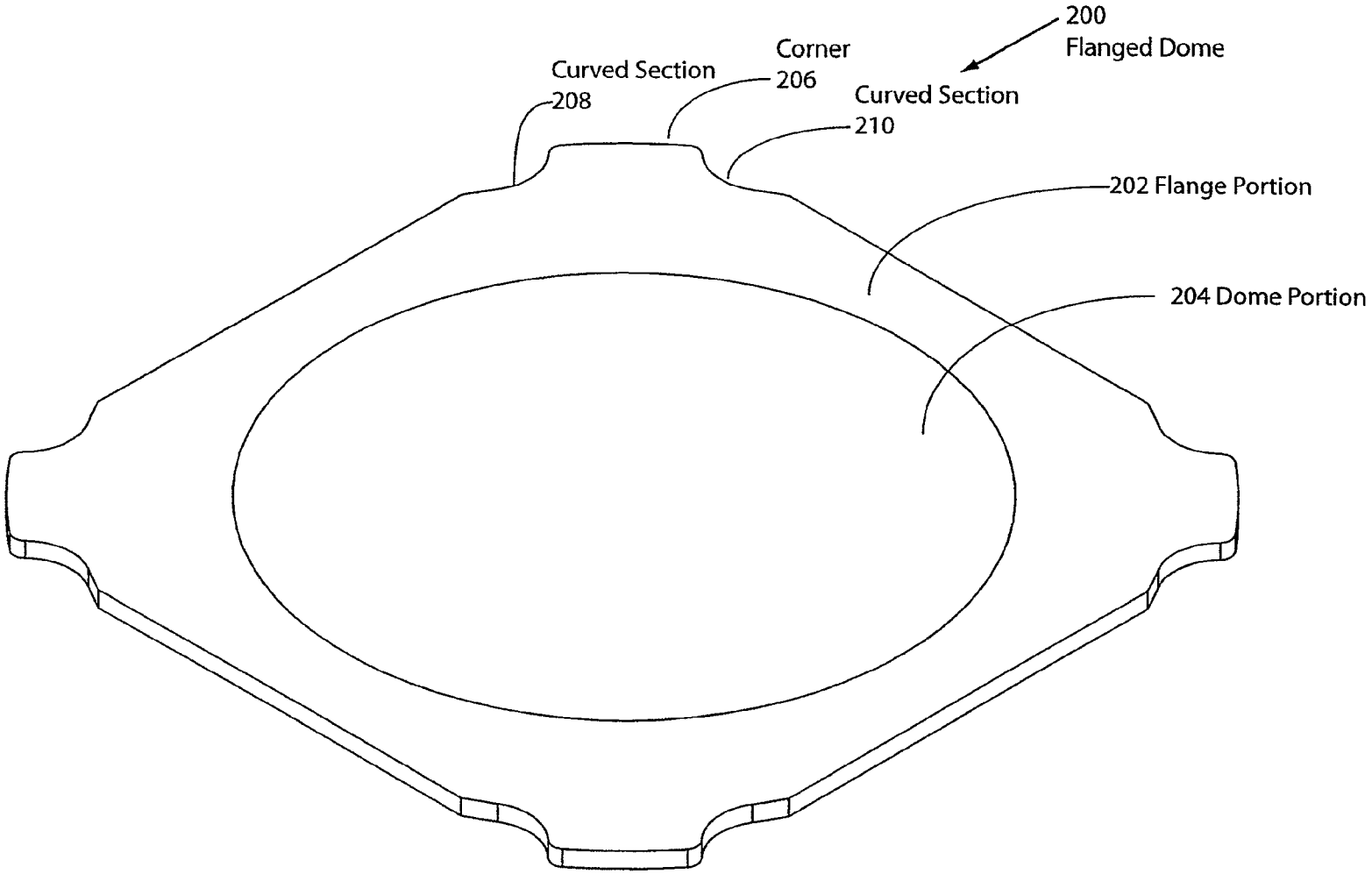
FIG. 2 is a perspective view of another embodiment of a flanged dome.

FIG. 2 is a perspective view of another embodiment of flanged dome 200. The flanged dome 200, illustrated in FIG. 2, is designed for manufacturability in a high speed automated process of manufacturing. Flanged dome 200 has a dome portion 204 and a flange portion 202. The flange portion 202 includes a corner 206 and curved sections 208, 210. The flange portion 202, as well as the dome portion 204, can be coated with a nickel coating, which prevents corrosion, provides consistency of operation and allows the flanged dome 200 to be easily soldered to a printed circuit board, as disclosed in more detail below. The thickness and diameter of the dome portion 202 dictates the pressure required to compress the dome portion 204. Precise automated techniques for forming the dome portion 204 provide consistency of operation of the dome portion 204.

Figure 3:
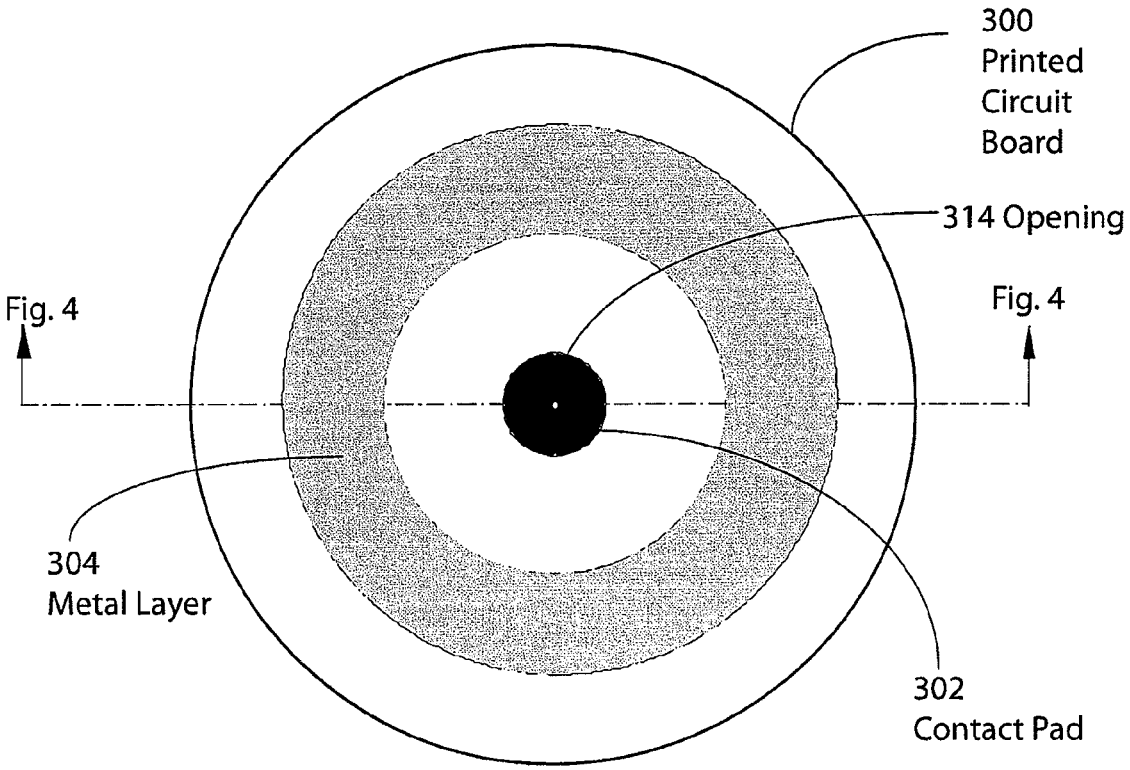
FIG. 3 is a top view of an embodiment of a printed circuit board.

FIG. 3 is a top view of a printed circuit board 300. As shown in FIG. 3, the printed circuit board 300 has a round shape. Other various shapes can be used including a generally square shape to match the flanged dome 200, that is illustrated in FIG. 2. As shown in FIG. 3, printed circuit board 300 includes an opening 314 that is centered in contact pad 302. Metal layer 304 may comprise a copper layer on the surface of the printed circuit board 300 to which a flange of the flanged dome is soldered or any other type of metal layer suitable for soldering.

Figure 4:
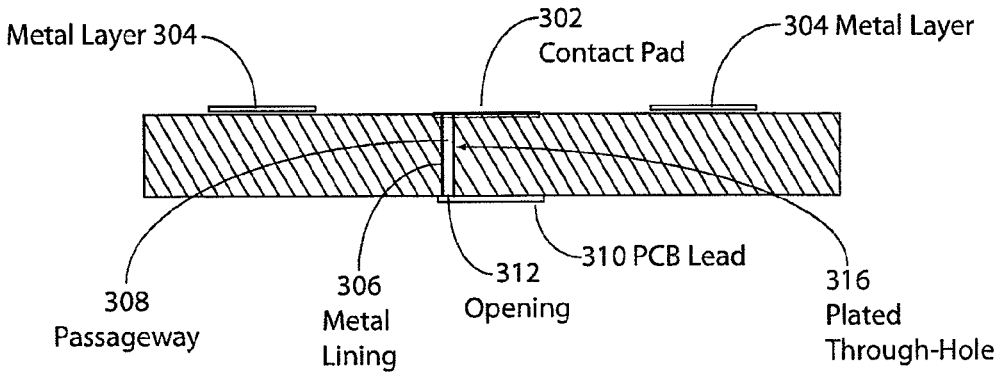
FIG. 4 is a side sectional view of the embodiment of the printed circuit board of FIG. 3.

FIG. 4 is a side sectional view of the embodiment of the printed circuit board 300, illustrated in FIG. 3. As shown in FIG. 4, the center of the contact pad 302 has an opening 312 that communicates with a plated through-hole 316. As shown in FIG. 4, the plated through-hole 316 includes a passageway 308 and metal lining 306. The passageway 308 allows a pressurized medium to pass through the printed circuit board 300, such as pressurized gas or liquid. The metal lining 306 of the plated through hole 316 conducts electricity from the contact pad 302 to the printed circuit board lead 310. Metal layer 304 comprises a portion of the printed circuit board that remains after etching that is securely adhered to the surface of the printed circuit board 300, in the same manner as the printed circuit board lead 310.

Figure 5:
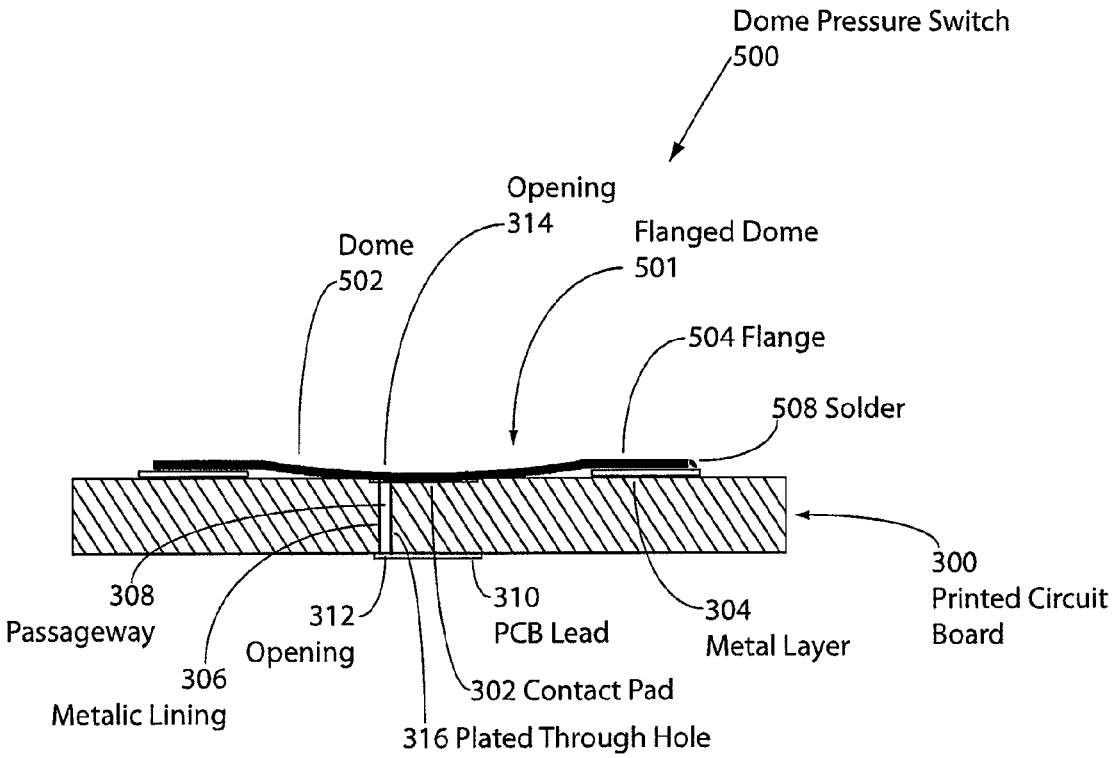
FIG. 5 is a side sectional view of one embodiment of a dome pressure switch.

FIG. 5 is a side sectional view of an embodiment of a dome pressure switch 500. Flanged dome 501 includes a flange 504 and a dome 502. Flange 504 is soldered to metal layer 304 with solder 508. The dome 502 electrically contacts the contact pad 302 as a result of the dome 502 being oriented in a downward configuration. Metal lining 306 of plated through hole 316 electrically contacts the contact pad 302 and the circuit board lead 310. The passageway 308 allows a pressurized medium to flow through the printed circuit board 300. Opening 314 in the contact pad 302, and opening 312 in the PCB lead 310, allow a pressurized medium to flow through the passageway 308 and create pressure on the surface of the dome 502 that is adjacent to the printed circuit board 300. The solder 508 that secures the flange portion 504 to the metal layer 304 provides an airtight, hermetical seal between the flange portion 504 and the metal layer 304 so that a pressurized medium flowing through the via 308 and openings 312, 314 create a pressure on the bottom side of the surface of the dome 502 to cause the dome 502 to deflect in a vertically upward direction, as shown in FIG. 5, upon reaching a predetermined pressure. Flange 504 is soldered to the metal layer 304 by various techniques including solder ovens in a high speed mechanized process. As the solder cools, the solder layer becomes thinner and pulls the flange 504, as well as the dome 502 in a downward direction towards the printed circuit board 300. This is a result of the fact that the solder shrinks during the cooling process. As a result, a loading force is created between the belly portion of the dome 502 that contacts the contact pad 302. The preload force ensures that a solid electrical contact is made between the belly of the dome 502 and the contact pad 302.

As also illustrated in FIG. 5, the solder 508 securely holds the flange 504 against the metal layer 304 so that the circumference of the dome 502 does not change when the dome 502 is depressed. This causes the dome 502 to move elastically when it is depressed and expands. In other words, the dome does not snap into a depressed configuration but elastically moves from an expanded position to a depressed position. This means that at any particular position of the dome 502, essentially the same force is required to depress the dome, as that required to maintain the dome in that position while the dome is expanding. In this manner, the dome 502 has little or no hysteresis. Lack of hysteresis results in the same amount of pressure being required to move the dome 502 away from the contact pad 302, as that required to maintain the dome 502 in a recessed position, resulting from elastic motion of the dome 502. Elastic movement of the dome 502 results in many more operational cycles of the dome 502 then a standard dome that is not constrained around the circumference of the dome and which exhibits hysteresis. As a result, the flanged dome 500 is extremely durable and is capable of operating over many cycles.

Figure 6:
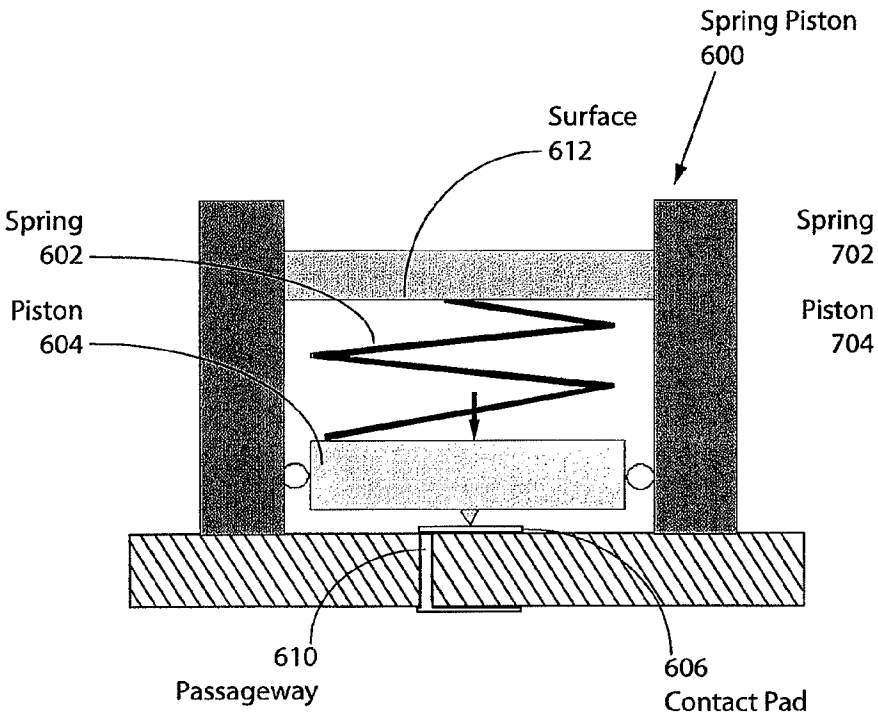
FIG. 6 is a schematic illustration of a spring piston analogy of the operation of a dome pressure switch.

FIG. 6 is a schematic illustration of an analogy of the manner of operation of the flanged dome 500 that is mounted on the printed circuit board 300, as illustrated in FIG. 5. As illustrated in FIG. 6, spring 602 is representative of the elastic motion of the dome 502. The spring is constrained by surface 612 of the spring piston 600. Spring 602 also pushes against piston 604, that is representative of the surface of the dome 502 that pushes against the contact pad 506. A pressurized medium flowing through passageway 610 can elastically compress spring 608 to cause piston 604 to vertically move away from, and not be in contact with, the contact pad 606. In other words, spring 602 operates elastically in the same manner as a dome with a constrained circumference so that there is no hysteresis in the movement of the piston 604.

Figure 7:
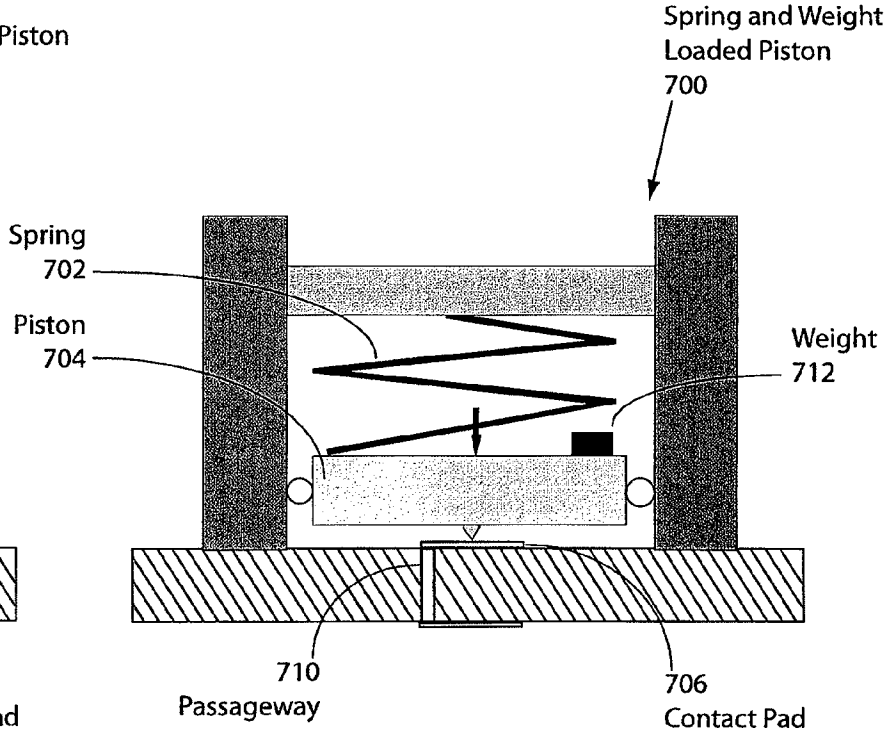
FIG. 7 is a schematic illustration of a spring and weight loaded piston analogy of the operation of dome pressure switch.

FIG. 7 is a schematic illustration of a spring and weight loaded piston 700 that is analogous to the preloaded dome, described above, with respect to FIG. 5. Again, a spring 702 is representative of the elastic motion of the dome, which is created by the constrained diameter of the dome as result of the flange being secured to a metal layer on a printed circuit board. A weight 712 is schematically illustrated in FIG. 7, that rests on piston 704 and adds an additional force or load to the piston 704. Weight on the piston causes the piston 704 to be preloaded against the contact pad 706, which ensures a solid electrical contact between piston 704 and the contact pad 706. In other words, the weight 712, which is equivalent to the preload force, as a result of the shrinking of the solder layer during cooling, provides an additional force in addition to the elastic force of the spring, which must be overcome by pressure applied to the surface of the dome by a pressure medium that flows through the passageway 710.

Figure 9:
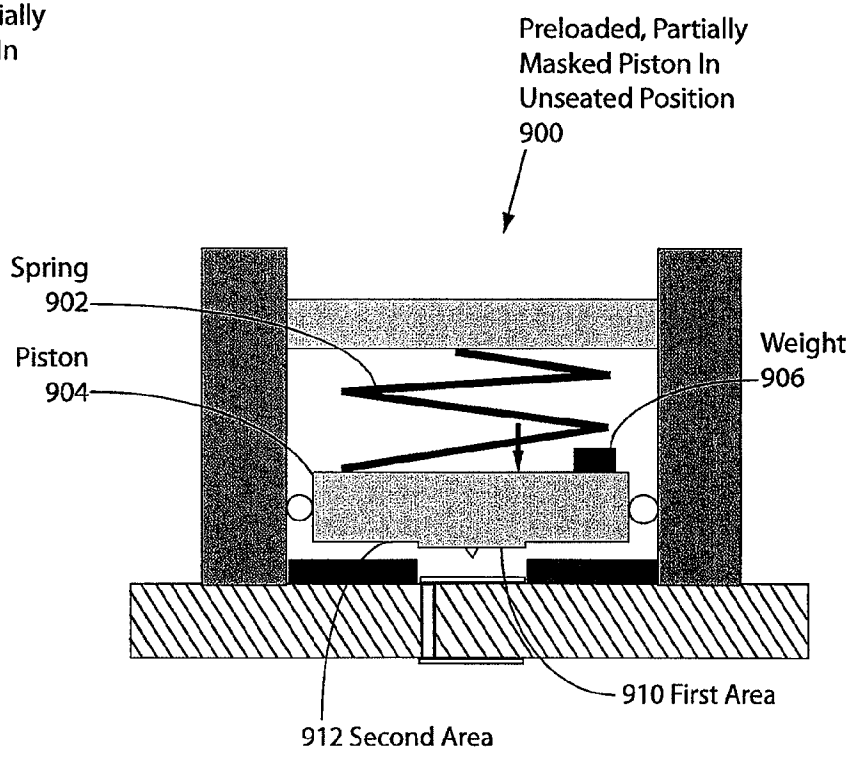
FIGS. 8 and 9 are schematic illustrations of pre-loaded, partially masked pistons illustrating the manner in which hysteresis may be introduced into the operation of a dome pressure switch.
Figure 8:
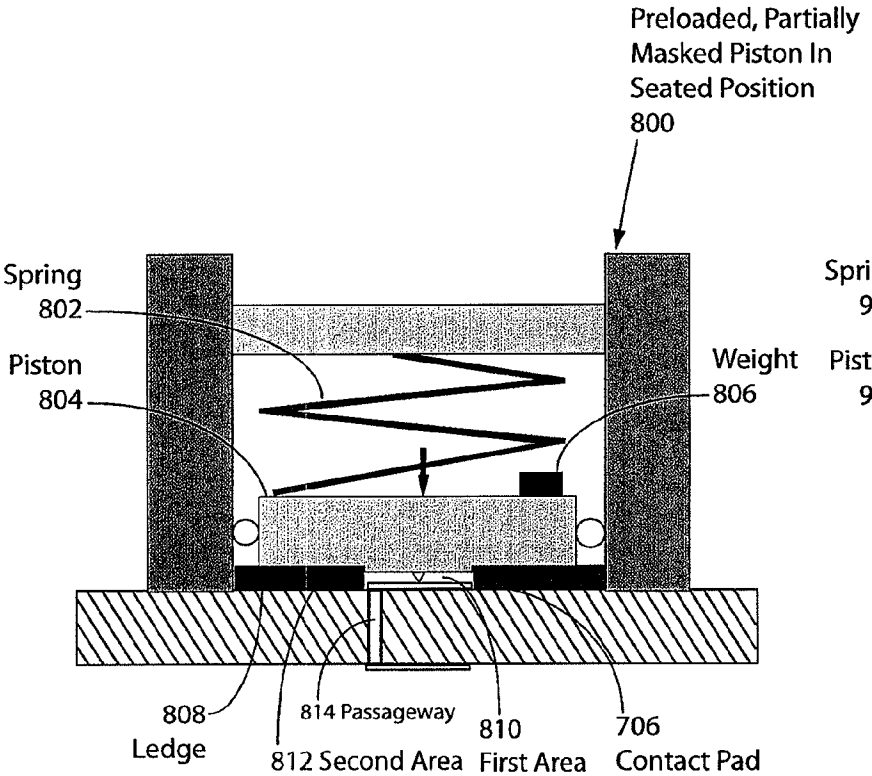

FIGS. 8 and 9 illustrate the manner in which hysteresis may be created and the effect that hysteresis has in the movement of the piston 804. FIG. 8 illustrates the effect of preloading on a partially masked piston in a seated position 800. As shown in FIG. 8, the piston 804 is held by a spring 802 and weight 806 against a ledge 808. The second area 812 of piston 804 is masked by the ledge 808. When a pressurized medium, such as air, or other gas or a fluid, enters through via 812, the pressurized medium generates a force against the first area 810 of piston 804. The ledge 808 provides a seat on which the surface of the piston 804 abuts, so that the pressurized medium entering from via 812 does not initially generate a force against the second area 812, but rather, asserts a pressure against the first area 810 of the surface of the piston 804. As shown in FIG. 9, a first predetermined pressure is applied to the first area 810 that is sufficient to compress the spring 802 and move the piston 804 in an upward direction so that both the first area 810 and second area 812 are exposed to the pressure medium. At that point, there is a larger surface area, i.e., first area 810 plus second area 812, so that a smaller pressure is required to maintain the piston 804 in a compressed upward position. As soon as the second area 812 is exposed to the pressurized medium, the piston moves rapidly to a higher position in which the spring 802 is compressed to a greater extent. This occurs very rapidly as the second area 812 is exposed to the pressurized medium. As the pressure of the pressurized medium is reduced, the piston will move to a seated position on the ledge 808. The pressure that allows the piston 804 to move downwardly to rest on the ledge 808 is less than the first predetermined pressure that was required to move the piston 804 to the compressed position that is illustrated in FIG. 9. Hence, that difference in pressures comprises the hysteresis that exists in the embodiments of FIGS. 8 and 9. A similar hysteresis can be created by masking the belly of a dome against a contact pad, if such hysteresis is desired. Generally, in most embodiments, very little hysteresis is desired. Some hysteresis may be desirable to prevent jitter of the switch when the pressure reaches the threshold level, which causes the switch to connect/disconnect. Referring again to FIG. 5, the contact pad 302 can be constructed to have a contact surface that matches the surface of the dome 502 to mask a portion of the dome and provide a desired amount of hysteresis. As such, a higher pressure may be required to depress the dome 502, than the pressure required to maintain the dome in a depressed position once the dome is depressed.

Figure 10:
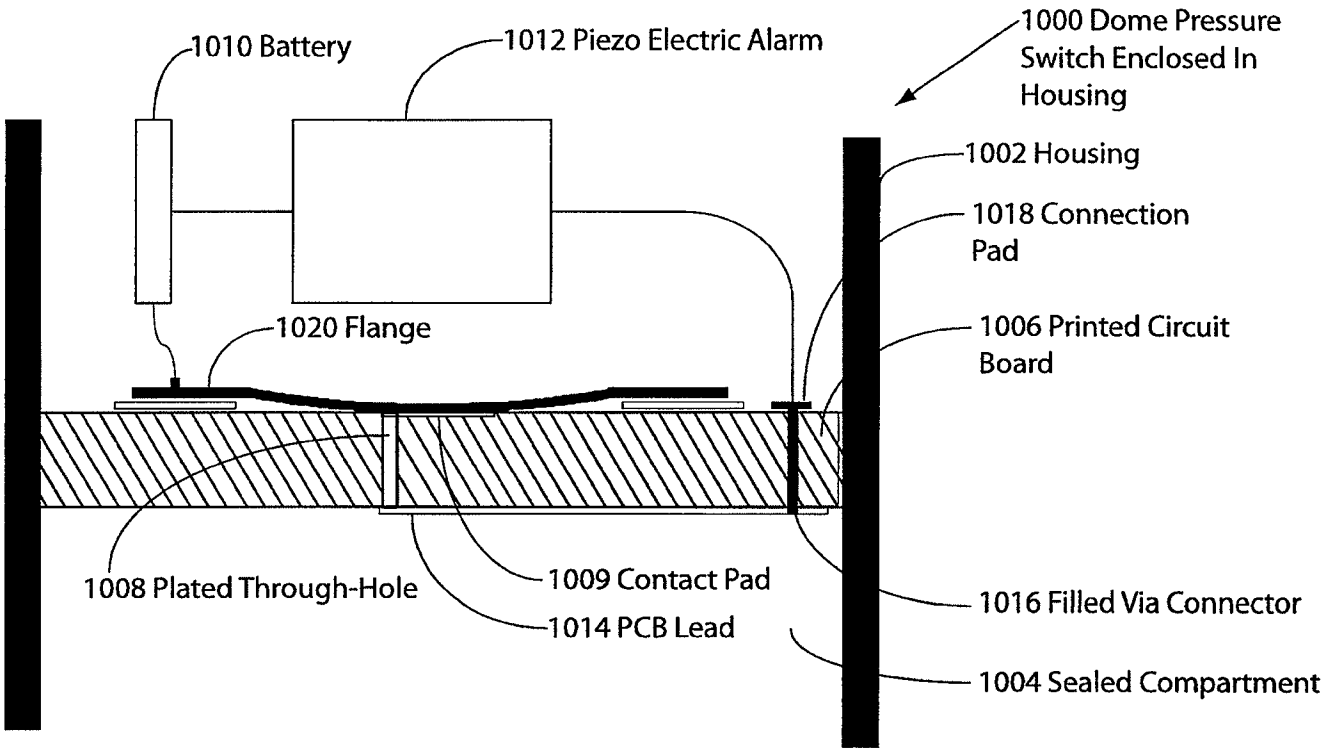
FIG. 10 is a schematic illustration of a dome pressure switch enclosed in a housing.

FIG. 10 is a side cutaway view of a dome pressure switch 1000 enclosed in a housing 1002. As illustrated in FIG. 10, the dome pressure switch 1000 comprises a printed circuit board 1006 and a dome 1007. The housing 1002 also includes a battery 1010 and a piezoelectric alarm 1012 that emits an audio alarm signal when the pressure in the sealed compartment 1004 falls below a predetermined threshold level. The printed circuit board 1006 includes a plated through hole 1008 that allows a pressurized medium, such as air or a fluid, in the sealed compartment 1004, to flow through the plated through hole 1008 and depress the dome 1007. The plating around the plated through hole 1008 is conductively connected to the contact pad 1009 and the PCB lead 1014. The printed circuit board lead 1014 is electrically connected to a filled via connector 1016, which is in turn connected to a connection pad 1018, which is electrically connected to the piezoelectric alarm 1012. Flange 1020 is electrically connected to the battery 1016 to complete the circuit.

In operation, a pressurized medium, such as a pressurized gas or pressurized fluid, is disposed in the sealed compartment 1004 of FIG. 10. For example, the sealed compartment 1004 may be connected to a tire stem on a car. The sealed compartment 1004 may also be connected by a tube to some other type of pressurized medium, such as a hydraulic system. When the pressurized medium is greater than a predetermined threshold pressure level, the dome 1007 is depressed and is not conductively connected to the contact pad 1009. When the dome 1007 is not in electrical contact with the contact pad 1009, the circuit, which includes the battery 1010 and the piezoelectric alarm 1012, is not connected. When the pressure of the pressurized medium falls below the predetermined threshold level, the dome 1007 expands and contacts the contact pad 1009 to establish a completed circuit so that the piezoelectric alarm 1012 is activated and emits an audible sound. In this manner, an alarm sounds when the pressure of the pressurized medium falls below a threshold level. As disclosed below, the embodiment illustrated in FIG. 10 could be employed as an inexpensive tire pressure monitor by connecting the sealed compartment 1004 to a tire, as disclosed in more detail below. Such devices may be used on a fleet of trucks so that at the end of the day a maintenance person can easily detect if any of the tires on a fleet of trucks are low by simply walking the line of trucks to determine if any of the tire pressure monitors are making an audible noise.

Figure 11:
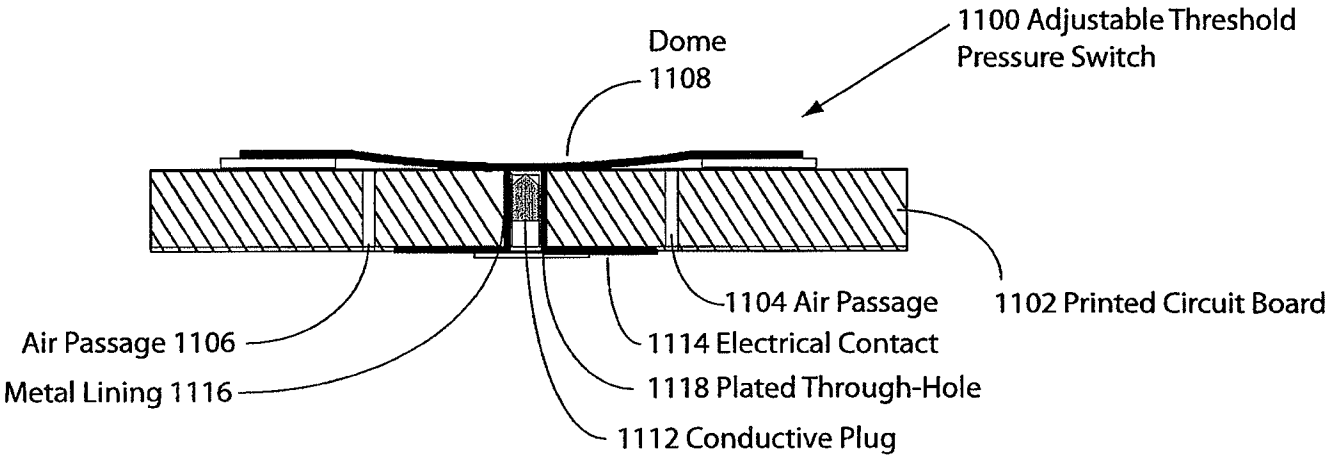
FIG. 11 is a schematic cutaway view of an embodiment of an adjustable dome pressure switch.

FIG. 11 is a schematic sectional view of an embodiment of an adjustable threshold pressure switch 1100. As shown in FIG. 11, a conductive plug 1112 is inserted in the plated through-hole 1118 of the printed circuit board 1102. Air passageways 1104, 1106 provide a passageway for a pressurized medium to flow through the printed circuit board 1102 to the dome 1108. The conductive plug 1112 is electrically connected to the metal lining 1116. Metal lining 1116 of the plated through-hole 1118 may be threaded to allow the conductive plug 1112 to be adjusted in the plated through-hole 1118. Alternatively, the conductive plug 1112 may be adjusted during the manufacturing process and anchored to the metal lining 1116 at the proper location to provide the desired pressure threshold.

In operation, the conductive plug 1112 can either be adjusted after construction of the adjustable threshold pressure switch 1100, or during a calibration process performed at the factory, by turning the conductive plug 1112 in threads provided between the conductive plug 1112 and the metallic lining 1116. By adjusting the conductive plug 1112, the pressure between the conductive plug 1112 and the dome 1108 can be adjusted similar to the adjustment of a preload force between the conductive plug 1112 and the dome 1108. By adjusting a preload force, the pressure threshold of the connection/disconnection force between the dome 1108 and the conductive plug 1112 can be adjusted. Alternatively, during fabrication of the adjustable threshold pressure switch 1100, the conductive plug 1112 can be moved to the desired position and anchored to the metal lining 1116, such as by soldering the conductive plug 1112 to the metal lining 1116. Other ways can be used to anchor the conductive plug 1112, including the use of adhesives. The adjustments of the conductive plug 1112 can be done by an empirical method in which pressure is applied through air passageways, such as air passageway 1104, and measuring the switching point for different pressure levels. In that manner, the conductive plug 1112 can be adjusted to the desired location and anchored to the metal lining 1116.

Figure 12:
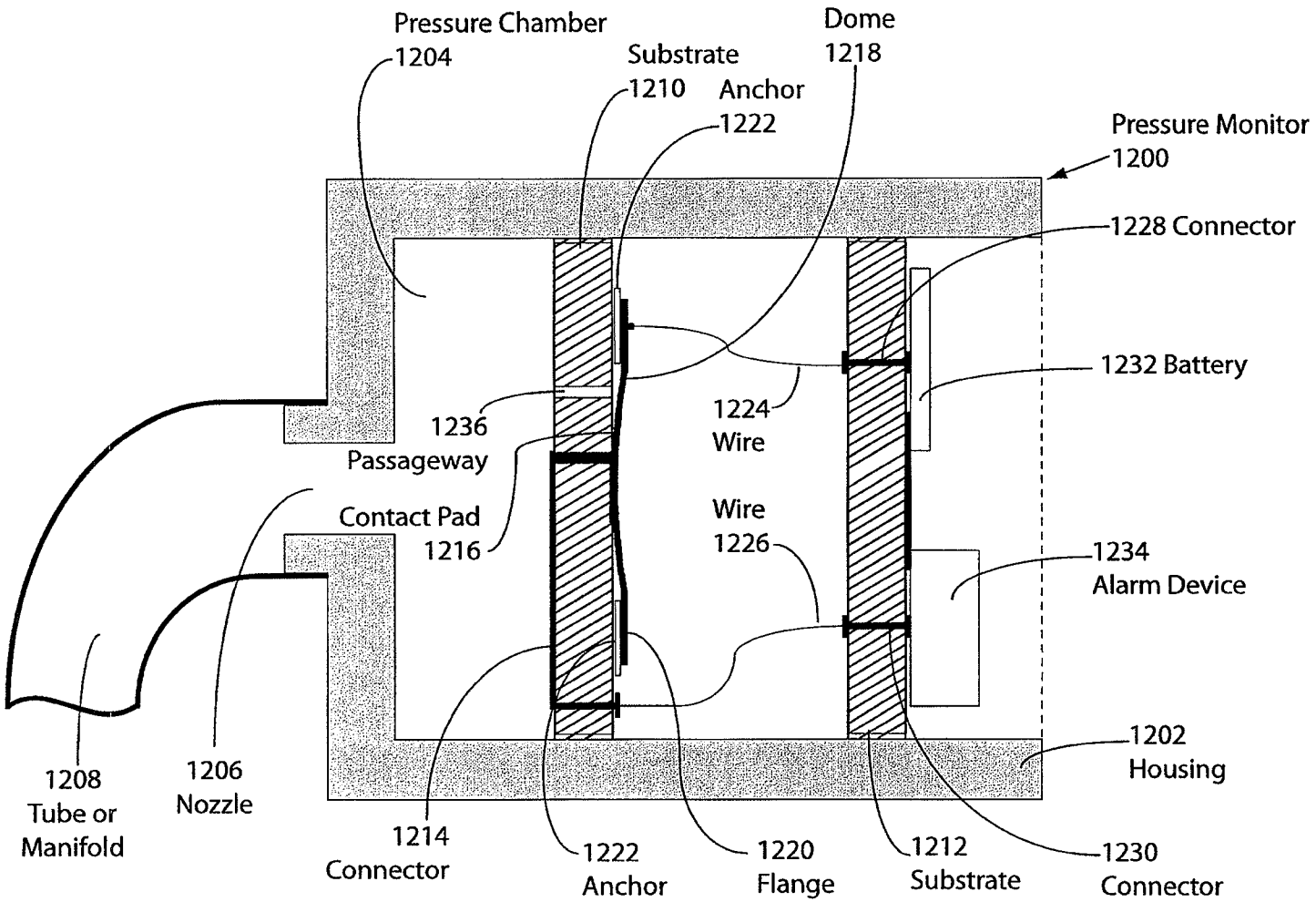
FIG. 12 is a schematic cutaway view of an embodiment of a pressure monitor.

FIG. 12 is a schematic sectional view of another embodiment of a pressure monitor 1200. As illustrated in FIG. 12, a housing 1202 includes a pressure chamber 1204. Pressure chamber 1204 has a nozzle 1206, which is coupled to a tube or manifold 1208 that, in turn, is connected to a pressurized medium. The pressurized medium can be from any source of a pressurized fluid or pressurized gas that is desired to be monitored. The pressure chamber 1204 is a sealed chamber that is sealed by the substrate 1210. Substrate 1210, as disclosed in the embodiment of FIG. 11, may constitute a printed circuit board, or may constitute any type of desired substrate that is capable of sealing the pressure chamber 1204. An additional substrate 1212 may also be provided that comprises a mount for a battery 1232 and an alarm device 1234. The alarm device 1234 may be any type of alarm device including a radio frequency generator, an audible alarm, an infrared generator, a light generator such as an LED, or any desired type of alarm device. The alarm device 1234 generates an alarm signal upon completion of the circuit disclosed in FIG. 12. Substrate 1212 can be any desired type of substrate including a printed circuit board that has printed circuit board leads for connecting the battery 1232 and the alarm device 1234.

As also illustrated in FIG. 12, dome 1218 is attached to the substrate 1210 with anchor 1222. Anchor 1222 can be solder that connects the flange 1220 to a printed circuit board metal layer when the substrate 1210 is a printed circuit board. Alternatively, anchor 1222 can be an adhesive or bonding agent, such as epoxy that adhesively bonds the flange 1220 to the substrate 1210. When anchoring the flange 1220 to the substrate 1210, a sufficient preload force can be created between the dome 1218 and the contact pad 1214 to ensure a solid electrical connection between dome 1218 and contact pad 1216. A preload force may be created by applying a predetermine pressure to the flange 1220 during a soldering process or gluing process. Additionally, the shrinkage of bonding agent or solder can also create a preload force between the dome 1218 and the contact pad 1216. A connector 1214 may be connected to a wire 1226, which is, in turn, connected to a connector 1230 that is attached to the alarm device 1234. Similarly, a wire 1224 may be connected to a connector 1228 that is in turn connected to battery 1232. A passageway 1236 in substrate 1210 allows the pressurized medium in pressure chamber 1204 to deflect the dome 1218 to cause the dome to connect and disconnect from the contact pad 1216.

FIG. 12 provides one particular layout of an embodiment of a pressure monitor 1200. Of course, other embodiments could also be used. For example, substrate 1210 may be sufficiently large to hold both the battery and the alarm. In such an instance, it may be desirable to use a printed circuit board so that all of the components can be joined together using printed circuit board leads. In addition, very small activation switches (not shown) can be employed to connect the circuit once the pressure monitor 1200 is connected to a pressure source.

Figure 13:
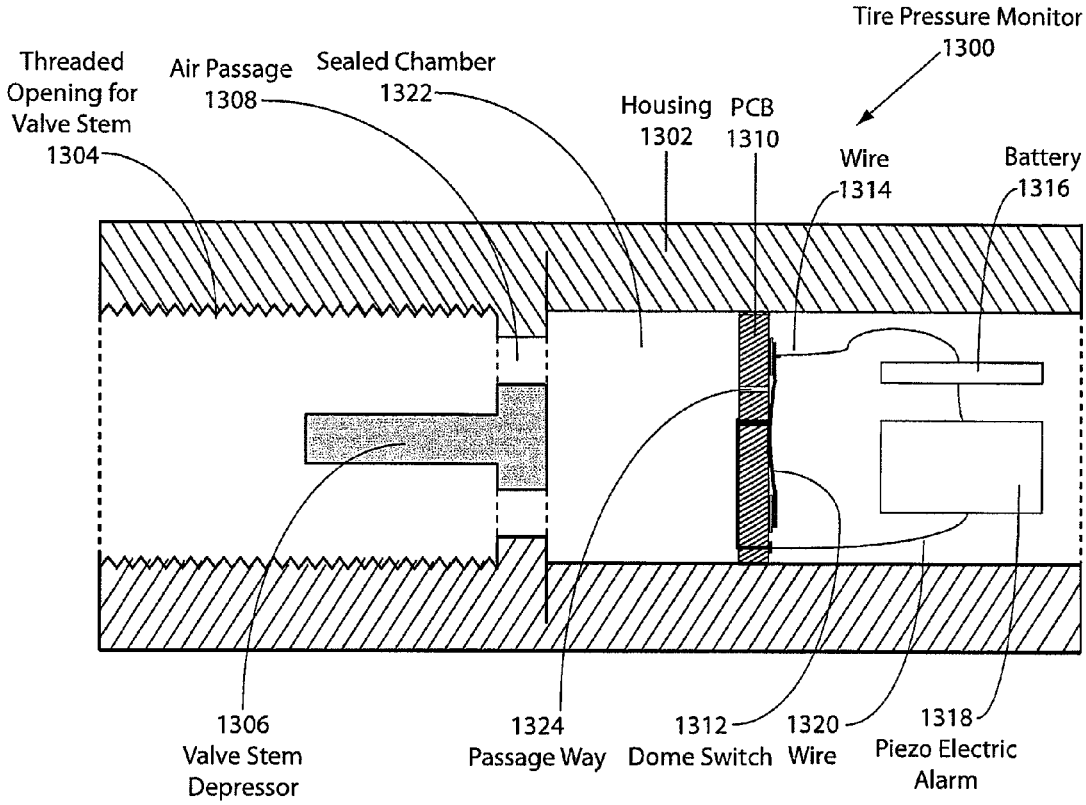
FIG. 13 is a schematic cutaway view of an embodiment of a tire pressure monitor.

FIG. 13 is a sectional view of an embodiment of a tire pressure monitor 1300. As shown in FIG. 13, housing 1302 includes a threaded opening 1304 that can be screwed onto a valve stem, such as a valve stem on a tire. A valve stem depressor 1306 is included as part of the structure of housing 1302 so that the valve stem of the tire is depressed when the housing 1302 is screwed onto the valve stem via the threaded opening 1304. Valve stem depressor 1306 depresses the valve stem and opens the pressure of the tire to the sealed chamber 1322. Printed circuit board 1310 includes a dome switch 1312 that operates in the manner described above. Passageway 1324 allows the pressurized air to flow from the tire through the printed circuit board 1310 and depress the dome of the dome switch 1312 to disconnect the circuit, which includes the battery 1316 and piezoelectric alarm 1318. Wire 1314 connects the dome switch 1312 to the battery 1316. Wire 1320 connects the piezoelectric alarm 1318 to various leads on the printed circuit board 1310 and the contact pad that is in electrical contact with the dome of the dome switch 1312, when the pressure of the tire is below a predetermined threshold level. Of course, any type of alarm can be used, including a device that generates an RF signal. In one example, a radio frequency ID signal can be generated using inexpensive antenna transponder devices that identify the particular pressure switch that has been activated.

Figure 14:
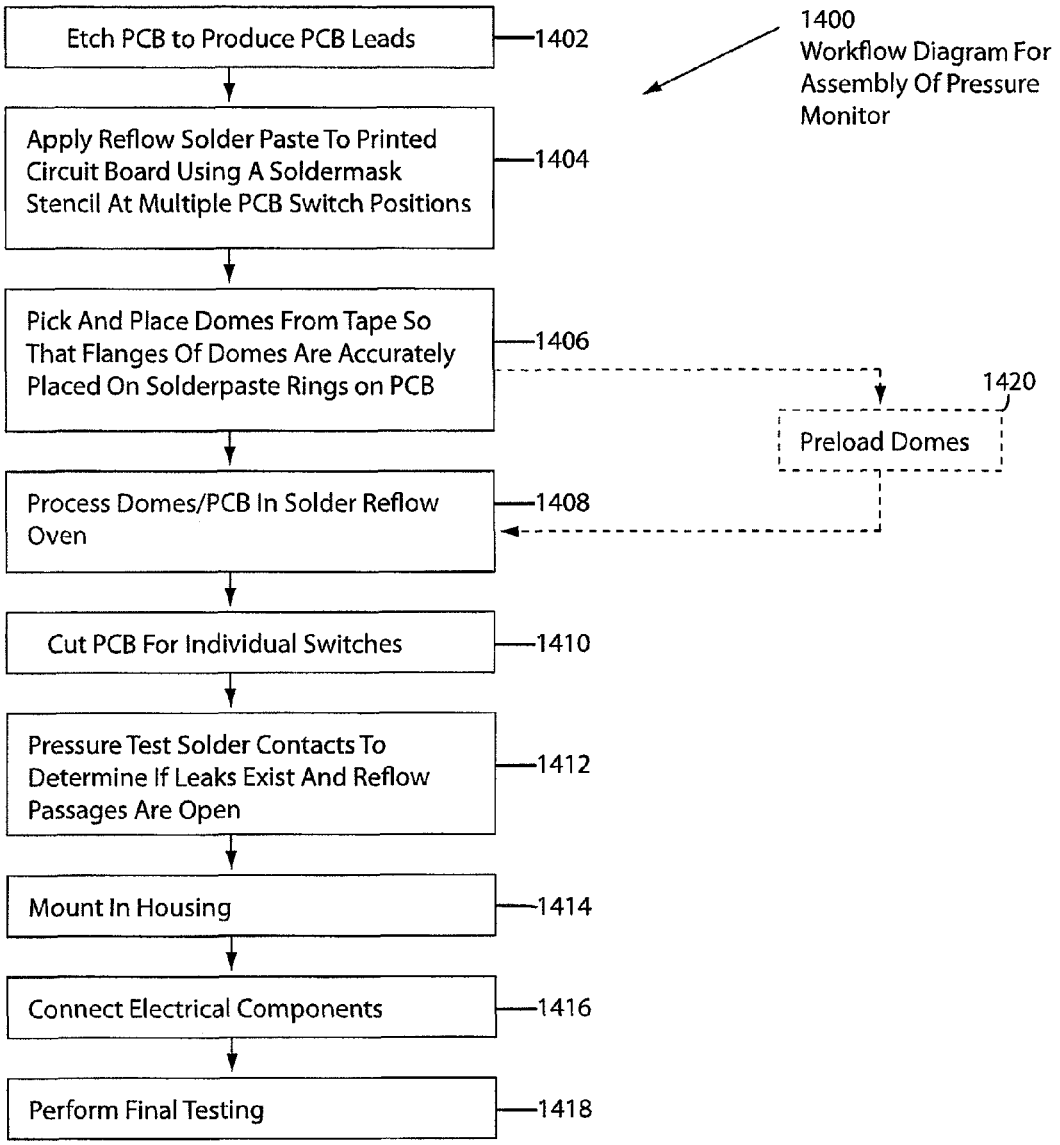
FIG. 14 is an embodiment of a work flow diagram for assembling a pressure switch.

FIG. 14 is a workflow diagram 1400 for assembly of a pressure monitor. At step 1402, the printed circuit board is etched to produce the proper printed circuit board leads, as well as generating filled vias and plated through-holes that may be required for a particular design of the pressure switch. At step 1404, a reflow solder paste is applied to the printed circuit board using a solder mask stencil at multiple positions on the printed circuit board. In other words, a single circuit board can be used to make multiple pressure switches. The reflow solder paste can be masked onto the printed circuit board at each of the locations where the flange of a dome is to be soldered to the printed circuit board, as well as other components. At step 1406, the domes are loaded onto the printed circuit board from a tape or other device holding the domes by a pick and place machine, such as a robot. The domes are placed on the printed circuit board so that the flanges of the domes are accurately placed on the solder paste rings that are deposited on the printed circuit board. At step 1408, the domes in the printed circuit board are processed in a solder reflow oven. Alternatively, at step 1420, the domes may be preloaded with a preload force, such as by weighting the domes, while the domes and printed circuit board are in the solder reflow oven. At step 1410, the printed circuit board is cut into individual switch devices. At step 1412, the solder contacts are pressure tested to determine if leaks exist between the dome and the printed circuit board. In addition, the flow passages are tested to ensure that the flow passages are capable of passing the pressurized medium. At step 1414, the switches are mounted in a housing. For example, the switch may be mounted in a housing for a tire pressure monitor. At step 1416, the electrical components are connected to the pressure switch. At step 1418, final testing is performed.

Figure 15:
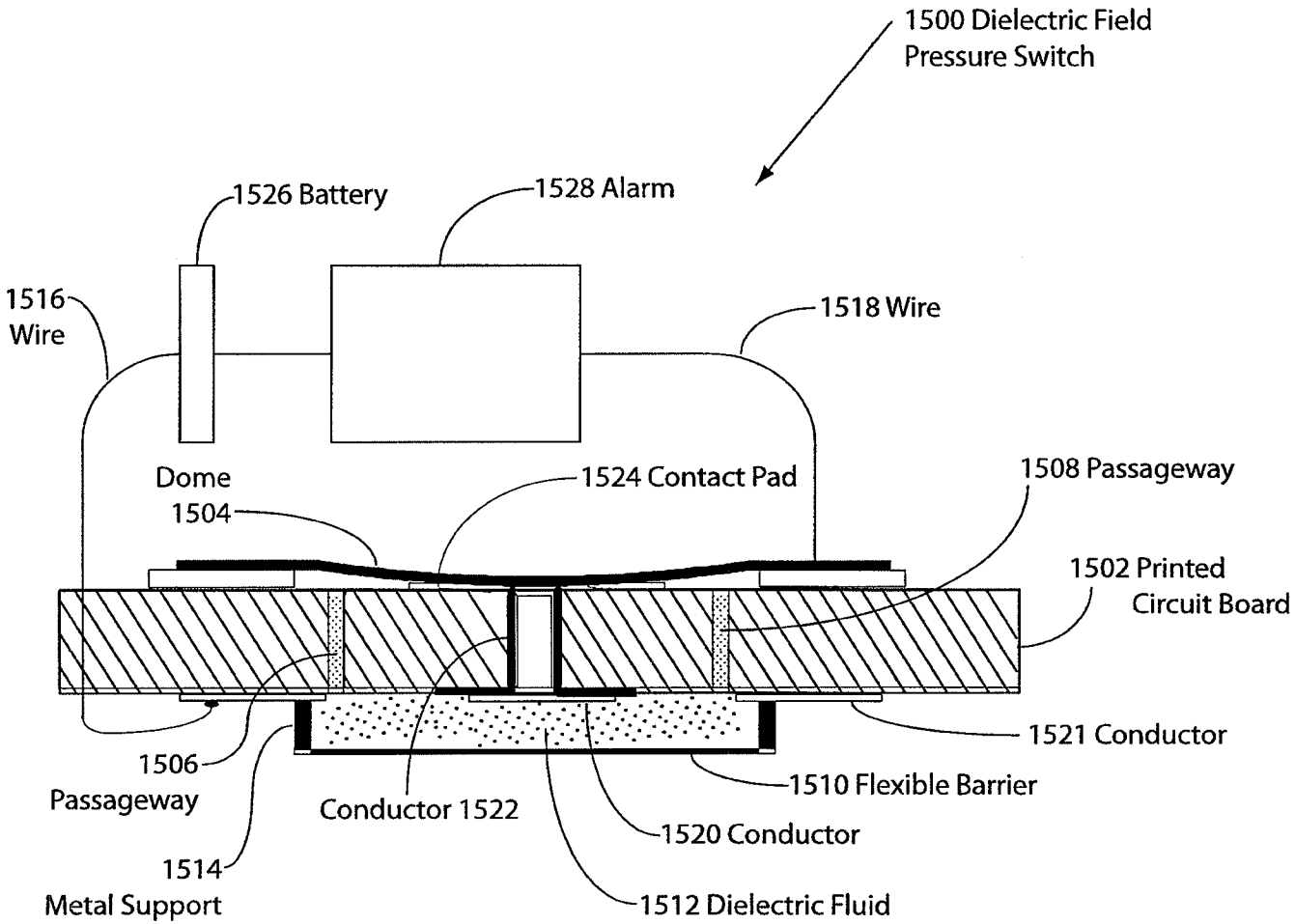
FIG. 15 is a schematic illustration of an embodiment of a dielectric fluid pressure switch.

FIG. 15 is a schematic sectional view of a dielectric fluid pressure switch 1500. As shown in FIG. 15, the dielectric fluid pressure switch 1500 includes a dielectric fluid 1512 that is encapsulated by a metal support 1514 that is secured to a connector 1520 on the bottom of the printed circuit board 1502. A flexible barrier 1510 is connected to the metal support 1514 so that the dielectric fluid 1512 is encapsulated by the flexible barrier 1510, the printed circuit board 1502 and the metal support 1514. Passageways 1506, 1508 allow the dielectric fluid 1512 to flow through the printed circuit board 1502 and engage the dome 1504. When pressure is applied to the flexible barrier 1510 by pressurized gas or a pressurized fluid, dome 1504 is depressed and moves away from the contact pad 1524 upon reaching a predetermined threshold pressure level. A filled via comprises a conductor 1522 that is coupled to the contact pad 1524 and a conductor 1520, which may comprise a lead on the printed circuit board 1502. Conductor 1520 is connected (not shown) to conductor 1521. The conductor 1520 is connected by a wire 1516 to the battery 1526, which in turn is connected to the alarm 1528. The circuit is completed by wire 1518 that is connected to a flange portion of the dome switch. Again, the battery 1526 and alarm 1528 can be mounted on separate boards or in separate portions of the dielectric fluid pressure switch 1500.

As shown in FIG. 15, encapsulation of the dielectric fluid 1512 prevents any contaminants from accessing the connection between the dome 1504 and the contact pad 1524. The flexible barrier 1510 transmits the pressure to the dome by way of passageways 1506, 1508. The dielectric fluid 1512 substantially fills all of the voids between the dome 1504 and the flexible barrier 1510, so that large differential pressures only flex the flexible barrier 1510 within the range of flexure of the flexible barrier 1510. Since the dielectric fluid 1512 is not compressible, pressure on the flexible barrier 1510 is directly translated to the dome 1504. A suitable dielectric fluid may include 3M Novec™ HFE-7100. Isolation of the switch surface between the dome 1504 and the contact pad 1524 allows the dielectric fluid pressure switch 1500 to operate over many cycles and protects the electrical contact between the dome 1504 and the contact pad 1524 from contaminants.

Figure 16:
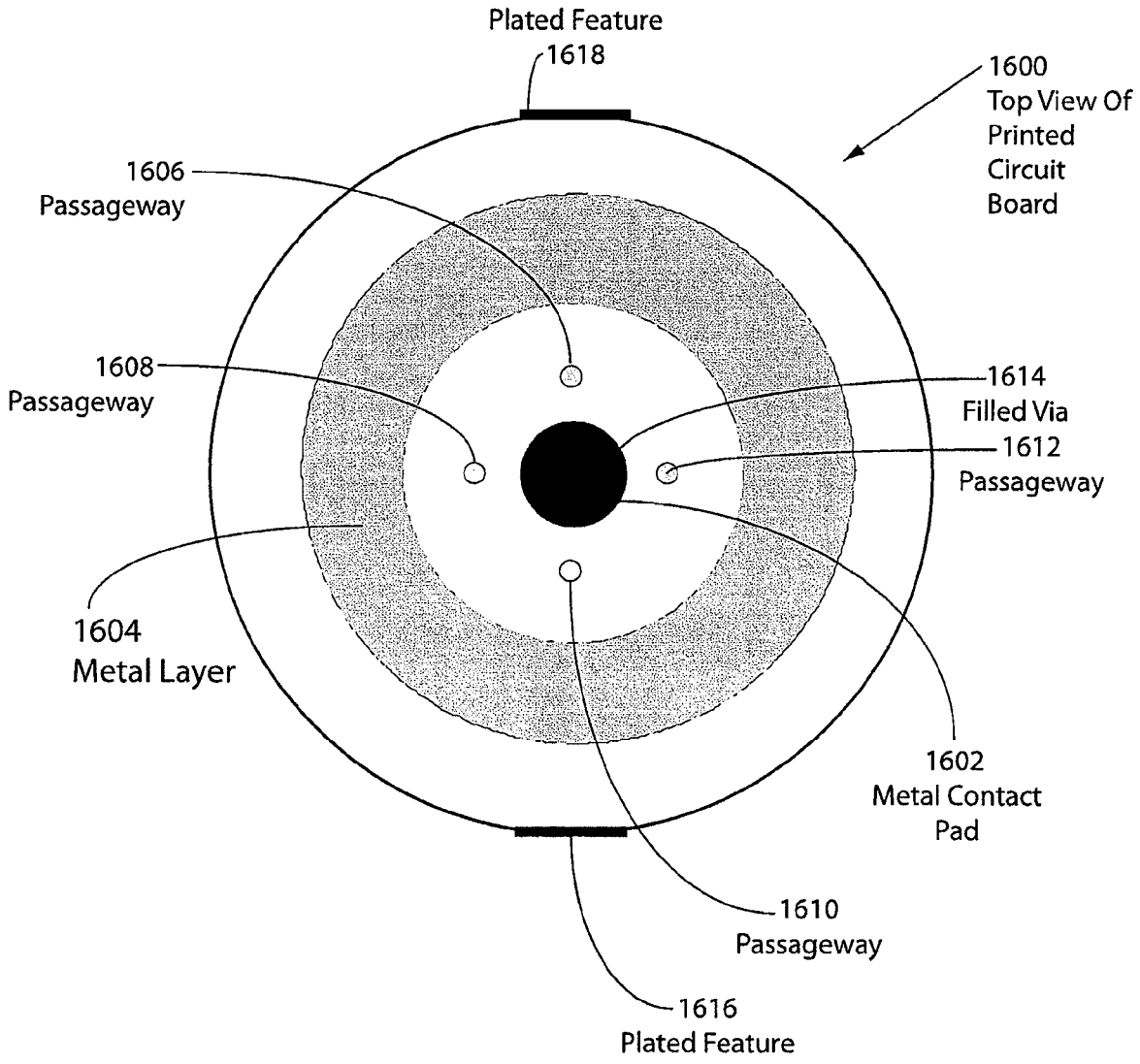
FIG. 16 is a top view of an embodiment of a printed circuit board.

FIG. 16 is a top view of another embodiment of a printed circuit board 1600. As shown in FIG. 16, there are four passageways 1606, 1608, 1610, 1612. These passageways 1606-1612 allow the flow of a pressurized medium through the printed circuit board 1600. A filled via 1614 passes through the printed circuit board 1600 and is electrically connected to the metal contact area 1602. Metal contact pad 1602 comprises a contact pad that is a metal layer that remains after etching the printed circuit board 1600. Similarly, metal layer 1604 comprises a metal layer that also remains after etching of the printed circuit board 1600. Metal layer 1604 is a layer on which the dome flange is soldered, so that the dome switch is anchored and sealed to the printed circuit board 1600. Plated features 1616, 1618 provide a connection between the top and bottom sides of the printed circuit board 1600.

Figure 17:
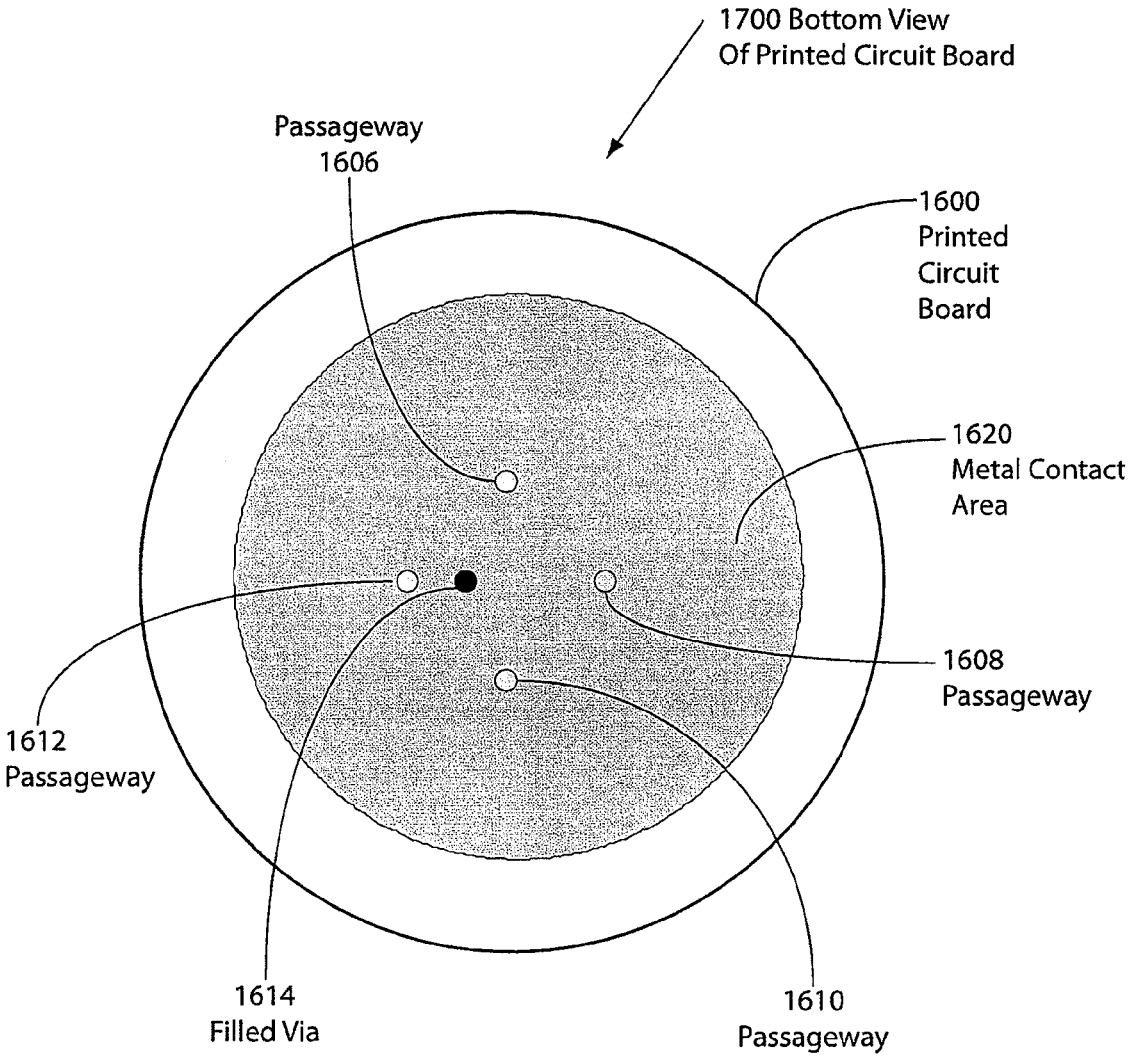
FIG. 17 is a bottom view of the embodiment of FIG. 16.

FIG. 17 is a bottom view of the printed circuit board 1700. As shown in FIG. 17, the printed circuit board 1600 has a metal contact area 1620, which is electrically connected to the filled via 1614. In this manner, the metal contact area 1620 is electrically connected to the contact pad 1602 (FIG. 16). Various electrical connections can be made between the metal contact area 1620 and circuits provided for the dome switch. Passageways 1606, 1608, 1610, 1612 are open through the metal contact area 1620, so that the pressurized medium can flow through the metal contact area 1620 and through the printed circuit board 1600.

Although FIGS. 16 and 17 illustrate an implementation of a dome switch on a printed circuit board, any desired type of substrate or base can be used, including a metal base. For a metal base, the flange of the dome can be welded, braised, or soldered along the circumference. Appropriate electrical isolation contacts and paths can also be designed for use with a metal base substrate.

Figure 18:
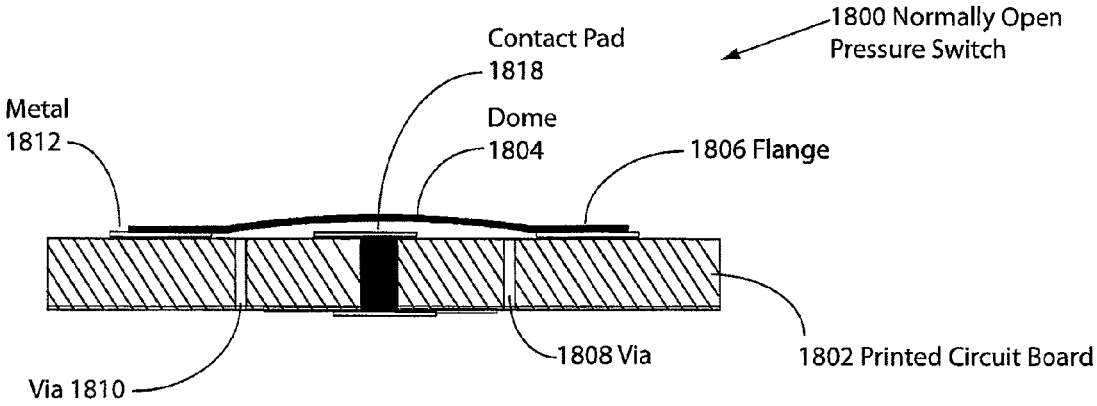
FIG. 18 is a schematic diagram of an embodiment of a normally open pressure switch.

FIG. 18 is a sectional diagram of another embodiment of a normally open pressure switch 1800. As shown in FIG. 18, the printed circuit board 1802 has a metal layer 1812 to which the flange 1806 is anchored. The flange 1806 may be soldered directly to the metal layer 1812 with the dome 1804 in an upward position, so that there is no electrical connection between the dome 1804 and the contact 1818. Passageways 1808, 1810 allow air between the dome 1804 and the printed circuit board 1802 to move through the printed circuit board when the dome 1804 is compressed. The flange 1806 is hermetically sealed to the metal layer 1812 so that a pressurized fluid does not pass between the flange 1806 and the printed circuit board 1802. The normally open pressure switch 1800 can be used to detect high pressure thresholds by applying the pressurized medium to the top portion of the dome 1804, as illustrated in FIG. 18. The normally open switch of FIG. 18 can also be used to detect low pressures. For example, a sealed chamber (not shown) can be created on the top portion of the printed circuit board 1802 and a pressurized medium can be maintained in the sealed chamber, which applies pressure to the top surface of the dome 1804, which causes the dome 1804 to contact the contact pad 1818. A second pressurized medium to be monitored can then be applied to a sealed chamber (not shown) on the bottom portion of the printed circuit board 1802, which causes the dome 1804 to move away from the contact pad 1818, so that there is no electrical contact between the contact pad 1818 and dome 1804. When the pressure level of the second pressurized medium falls below a predetermined threshold level, the pressurized medium on the top surface of the dome 1804 causes the dome 1804 to contact the contact pad 1818. In this manner, the normally open pressure switch 1800 can be used to detect when a pressure medium falls below a predetermined threshold pressure.

Figure 19:
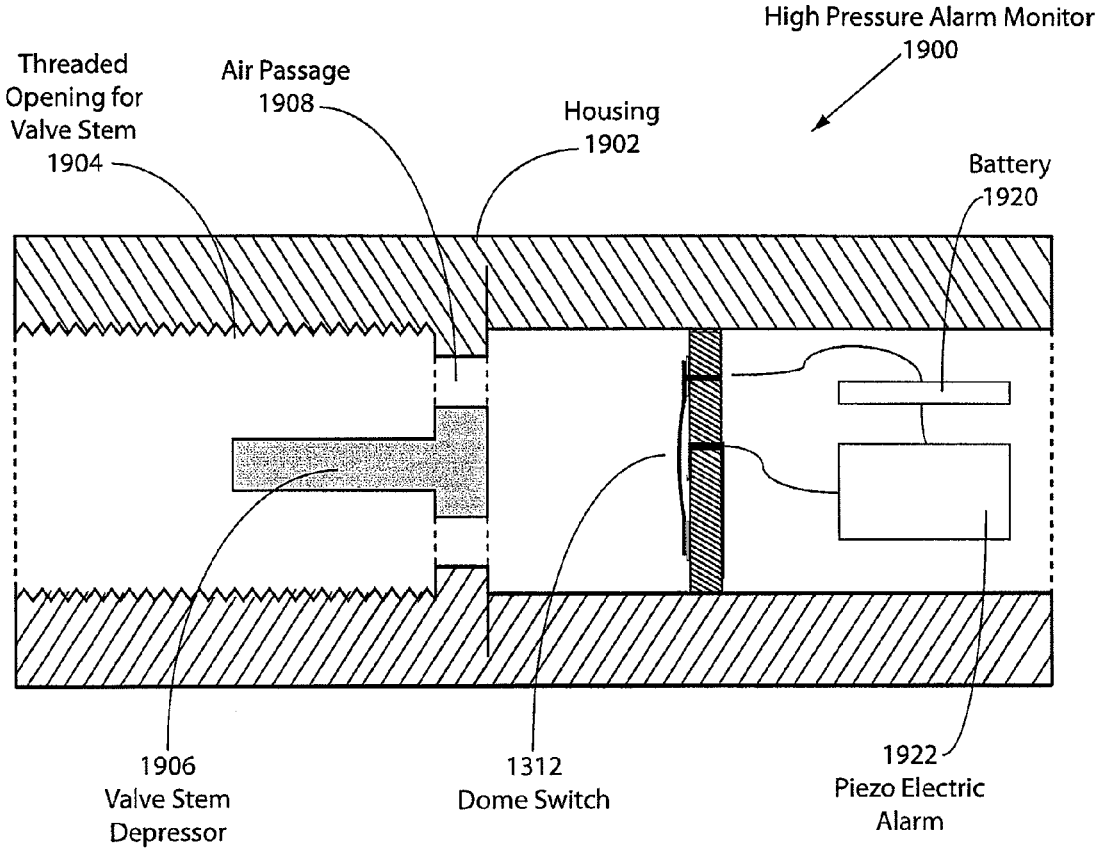
FIG. 19 is a side sectional view of an embodiment of a high pressure alarm monitor.

FIG. 19 is a schematic cutaway view of an embodiment of a high pressure tire alarm monitor 1900. As shown in FIG. 19, the high pressure tire alarm monitor is disposed in a housing 1902 for detecting high pressure in a tire. A threaded opening 1904 is designed to fit a valve stem on a tire. Valve stem depressor 1906 depresses the valve stem and allows pressure from the tire to enter through the air passage 1908 and contact the dome 1912. When the pressure from the tire exceeds a predetermined threshold, the dome 1912 is depressed and makes contact with contact pad 1924 to complete the circuit through the battery 1912 and piezoelectric alarm 1922. This causes the piezoelectric alarm to sound an alarm, indicating that the pressure in the tire has exceeded a predetermined threshold level. Of course, the high pressure alarm monitor can be used for various implementations for detecting high pressures, other than for a tire. The normally open pressure switch, illustrated in FIG. 19, can be employed in any desired manner to detect when a pressure exceeds a predetermined threshold.

Hence, the embodiments of the pressure switches that are utilized in the various implementations disclosed herein provide a novel and unique manner of utilizing a flanged dome as a pressure switch. By reversing the manner in which a dome typically operates, i.e., normally open, and employing the dome in a preloaded electrical contact configuration, an inexpensive, small and reliable switch can be constructed. By constricting movement of the circumference of the dome by securing the flange to a substrate, the dome moves elastically, i.e., in a spring-like manner, which increases the operating lifetime of the switch. Various embodiments disclosed above employ the dome in unique, normally closed implementations. Domes are usually in a normally open position and are mechanically depressed to a closed position upon application of pressure, such as by a finger or other device. Disclosed embodiments utilize domes in a very different manner in a normally closed configuration. Further, domes are not utilized in the prior art in fluid differential pressure actuated electrical switches, but rather, as mechanical (tactile) force actuated switches.

In addition, a flange has been added to the dome, which not only provides a surface for attaching the dome to a substrate, but also restricts the expansion of the circumference of the dome, so that the dome moves elastically. The flange provides a flat surface for soldering the dome switch to a printed circuit board and provides a pressure tight seal.

By soldering the flange to a printed circuit board or otherwise securing the flange to a substrate, the circumference of the dome is fixed. By fixing of the circumference of the dome, the dome moves elastically, with little or no hysteresis and eliminates the snap action that is related to dome hysteresis. A very high number of switch cycles can be achieved as a result of the elastic movement of the dome prior to failure because the dome remains in elastic movement.

The use of a printed circuit board as a substrate for the dome switch allows the dome to be soldered to the metal plating of the printed circuit board. The metal plating of the printed circuit boards can be easily etched and provide a convenient and inexpensive way of creating the necessary electrical paths, as well as the metal surfaces for soldering the flanged dome. In addition, the switch can be integrated into a larger printed circuit board design and populated with other components.

When the flanged dome is soldered to the metal surface of the printed circuit board, the reflow soldering acts to secure the flange of the dome to the metal surface of the printed circuit board and create an electrical contact. When the reflow solder cools, the thickness of the solder layer is reduced, which puts the dome into metallurgical strain against the contact pad on the printed circuit board, which creates a preload force between the dome and the contact pad. The preload force provides a good electrical contact between the contact pad and the dome.

As also disclosed above, masking between the dome and the contact pad can create a desired amount of hysteresis, which prevents any jittering of the dome switch when the pressure reaches the threshold level.

Pressure switches using the dome switch can be made very small and very light. Pressure switches using domes are much less expensive than currently available pressure switches, and are robust, since the design uses rugged components, such as a dome switch and a printed circuit board that are soldered together. There are few moving mechanical parts, since the dome only flexes to connect and disconnect the electrical contact with the contact pad. The threshold at which the dome makes contact can be adjusted using the techniques disclosed herein. Adjustment can be made during manufacture or by an end user. The dielectric fluid pressure switch, disclosed above, can be designed for use in environments that would otherwise foul the switch contacts. Also, the entire process of making the pressure switch is amenable to conventional, high volume manufacturing processes.

As indicated with respect to FIGS. 8 and 9, it may be desirable to introduce hysteresis into the pressure switch to prevent jitter within the switch. Because the flange of the dome is normally solidly connected to a substrate, the dome has a substantially elastic response, since the flange portion does not expand and contract in a manner that would ordinarily result in hysteresis of the movement of the dome. As indicated with respect to FIGS. 8 and 9, hysteresis can be created by masking the belly of the dome against a contact pad.

Figure 20:
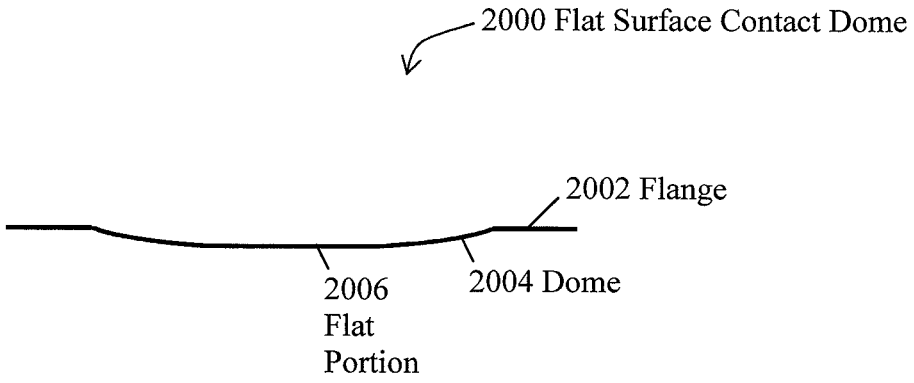
FIG. 20 illustrates a flat surface contact dome.

FIG. 20 illustrates a flat surface contact dome 2000. As illustrated in FIG. 20, flange 2002 may be soldered, or otherwise connected, to a printed circuit board or other substrate, which causes the flange 2002 to be held solidly in place. As such, expansion and contraction of the flange 2002 does not occur, and the movement of the dome 2004 is substantially elastic. Without hysteresis and a purely elastic motion, a series of substantially short connections may be created between the dome and the contact pad. In many cases, this type of jitter in the connection creates multiple instantaneous connections, rather than a single decisive connection. Accordingly, at least some hysteresis is desirable. In that regard, the flat portion 2006 of the flat surface contact dome 2000 functions to mask the dome against the contact pad and thereby create hysteresis. By using a contact pad that has a flat surface that matches the flat portion 2006 of the flat surface contact dome 2000, higher pressure is initially required to cause the dome 2004 to deflect than is required to maintain the dome in a depressed orientation, since the flat portion 2006 is subtracted from the overall surface of the dome 2004 prior to the depression of the dome 2004. Further, the larger the flat portion 2006 of the dome 2004, the smaller the surface area of the dome 2004, which is subjected to the pressurized fluid prior to deflection of dome 2004, which results in more pressure being required to cause the dome 2004 to deflect. Once the dome deflects, the flat portion 2006 is separated from the contact pad and is subjected to the pressure of the pressurized fluid. Since there is more surface area that is subjected to the pressurized fluid, since the flat portion 2006 is separated from the contact pad, less pressure is required to maintain the dome 2004 in a deflected, or upward, position, as shown in FIG. 20. Accordingly, as the flat portion 2006 is increased in size, there is more hysteresis that is created in the flat surface contact dome 2000. In this manner, the size of the flat portion 2006 can be designed to create the desired amount of hysteresis in the flat surface contact dome 2000.

Figure 21:
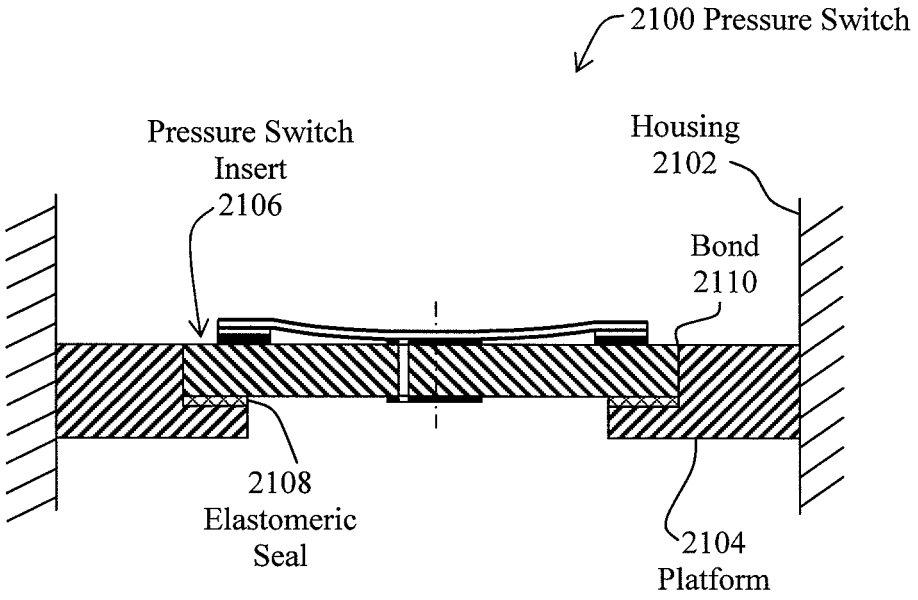
FIG. 21 is a cross-sectional view of another embodiment of a pressure switch.

FIG. 21 is a cross-sectional view of another embodiment of a pressure switch 2100. As shown in FIG. 21, the pressure switch 2100 is disposed in a housing 2102. A platform 2104 is connected to the housing 2102 in any desired fashion, including gluing, bonding, welding, etc. In fact, platform 2102 may be formed as a portion of the housing 2102. A pressure switch insert 2106 is provided that is supported in a recess on the platform 2104. Bond 2110 secures the pressure switch insert 2106 to the platform 2104. An elastomeric seal 2108 is provided between the pressure switch insert 2106 and the platform 2104. The elastomeric seal 2108 provides an additional sealing mechanism for sealing the pressure switch insert 2106 to the platform 2104 and, hence, to the housing 2102. In this manner, rather than simply attaching the pressurized switch directly to the housing 2102 by permanently bonding the pressure switch to the housing 2102, the pressure switch insert 2106 can be placed within the platform 2104 and bonded to the platform 2104 by bond 2110 and further sealed using an elastomeric seal 2108. The elastomeric seal 2108 can be sealed at a desired pressure by forcing the pressure switch insert 2106 into the platform 2104 using a predetermined force until the pressure switch insert 2106 is bonded to the platform 2104 using bond 2110.

Figure 22:
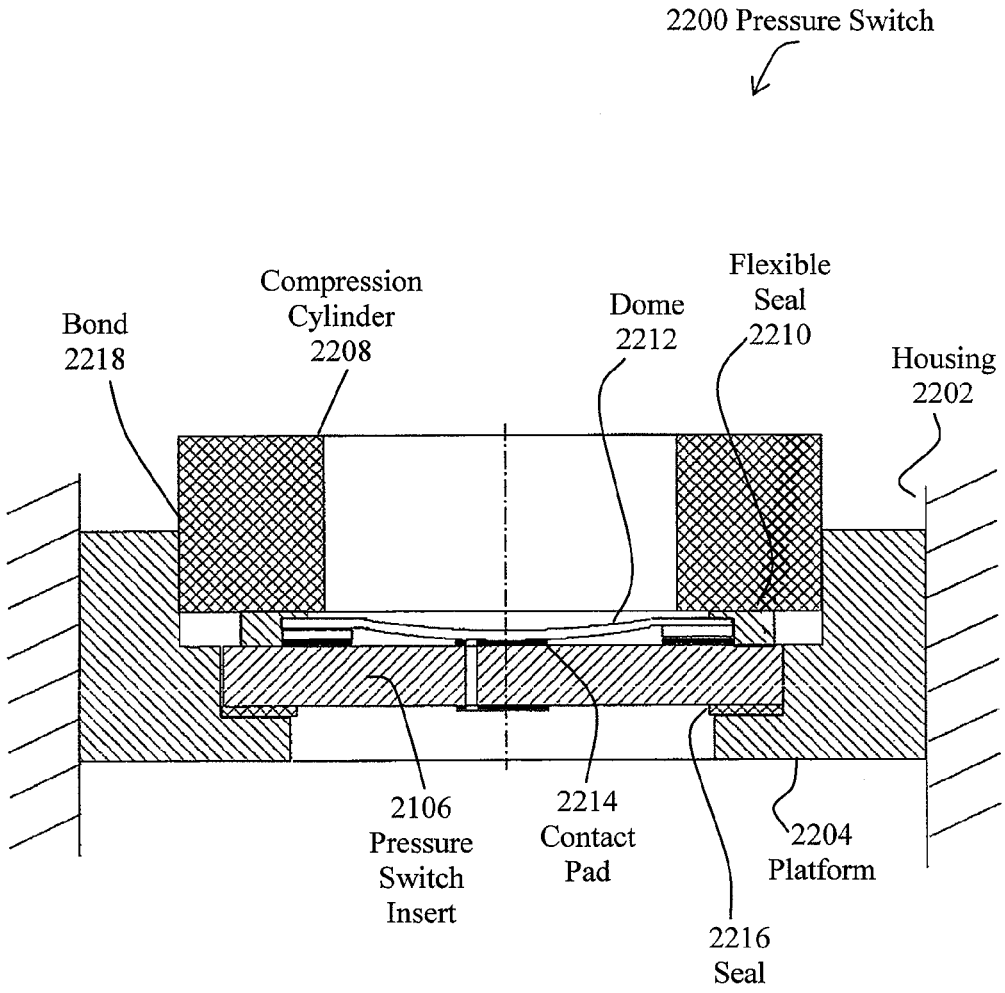
FIG. 22 illustrates another embodiment of a pressure switch.

FIG. 22 illustrates another embodiment of a pressure switch 2200. As shown in FIG. 22, platform 2204 is connected to, or forms part of, the housing 2202. A pressure switch insert 2106 is placed in a recess on the platform 2204. Seal 2216 seals the pressure switch insert 2106 to the platform 2204. Pressure switch insert 2106 may then be bonded to the platform 2204. A compression cylinder or annulus 2208 is then placed on top of the pressure switch insert 2106 and generates a downward force on the pressure switch insert 2106 and on the flange portions of the dome 2112. As described above, the preloading of pressure on the dome 2112 against the contact pad 2214 ensures a solid electrical contact between the dome 2212 and the contact pad 2214. The amount of preloading force of the dome 2212 against the contact pad 2214 adjusts the amount of pressure that is required to cause the dome 2212 to deflect. By controlling the force of the compression cylinder 2208 against the flexible seal 2210 and the flange portion of the dome 2212, the preloading force can be adjusted. Once the desired preloading force is created, the compression cylinder 2208 can be bonded to the platform 2204 with bond 2218. The pressure on the flexible seal 2210 is also sufficient to create an airtight seal between the opening in the compression cylinder 2208 and the lower portion of the pressure switch insert 2206.

Figure 23:
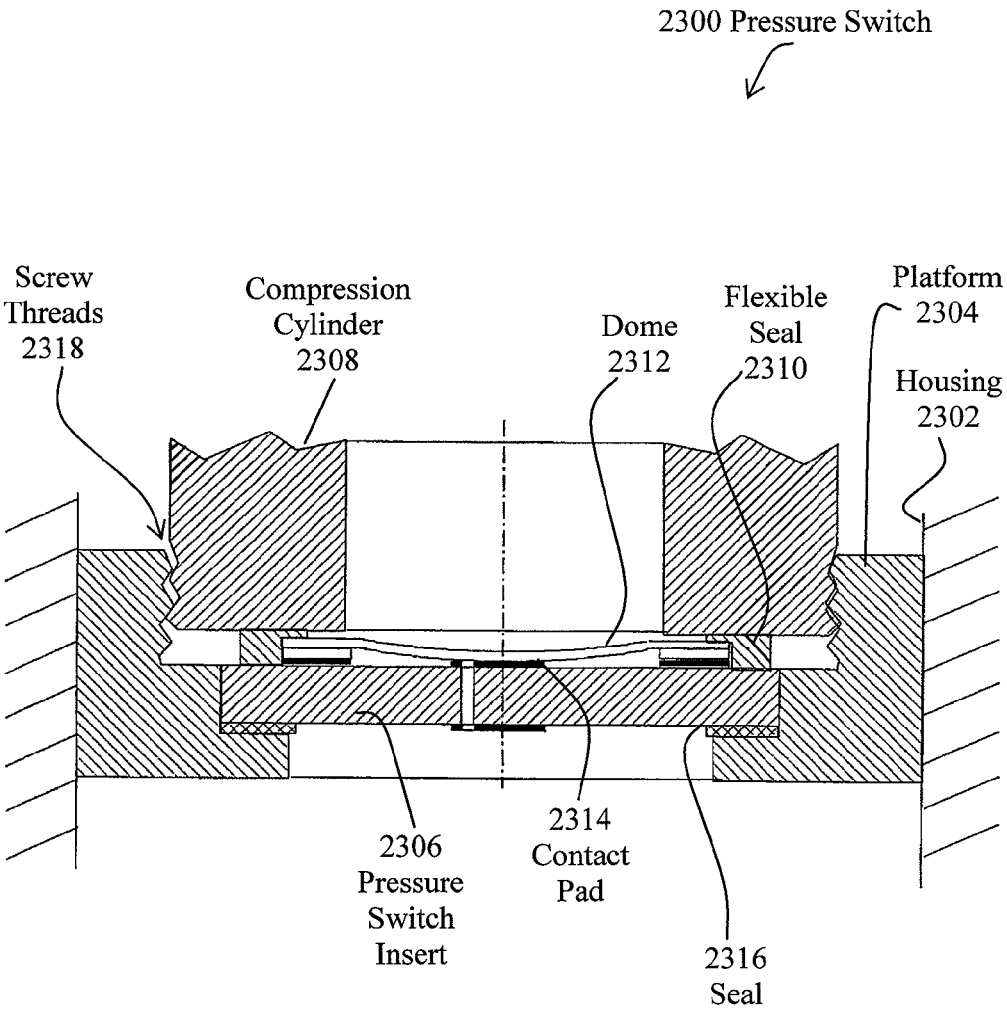
FIG. 23 illustrates another embodiment of a pressure switch.

FIG. 23 illustrates another embodiment of a pressure switch 2300. As illustrated in FIG. 23, platform 2304 may be secured to the housing 2302 or may form a portion of the housing 2302. Pressure switch insert 2306 is placed on the platform 2304 and on the seal 2316. Again, seal 2316 provides an additional seal between the pressure switch insert 2306 and the platform 2304, in case the bond and seal between the pressure switch insert 2306 and the platform 2304 is not complete.

As also shown in FIG. 23, the compression cylinder 2308 provides a preloading force between the dome 2312 on the contact pad 2314. Threads 2318 couple the compression cylinder 2308 to the platform 2304. As the compression cylinder 2308 is rotated, force is created on the flexible seal 2310 and the flange portions of the dome 2312. Pressure on the flange portions of the dome 2312 generate a preloading force between the dome 2312 and the contact pad 2314, as the dome moves in a downward direction, as illustrated in FIG. 23. Accordingly, the preloading force between the dome 2312 and the contact pad 2314 can be adjusted by rotating the compressing cylinder 2308, which is threaded to the platform 2304. The preloading force can be empirically adjusted by generating a pressure level in the chamber 2320, which is slightly lower than the pressure at which it is desired that the dome 2312 will disconnect from the contact pad 2314. The compression cylinder 2308 can then be rotated slowly outwardly until the dome 2312 extends and contacts the contact pad 2314. The pressure switch 2300 can then be tested by increasing and decreasing the pressure of the fluid within the chamber 2320, so that connection and disconnection between the dome 2312 and contact pad 2314 occurs at the desired pressure.

Figure 24:
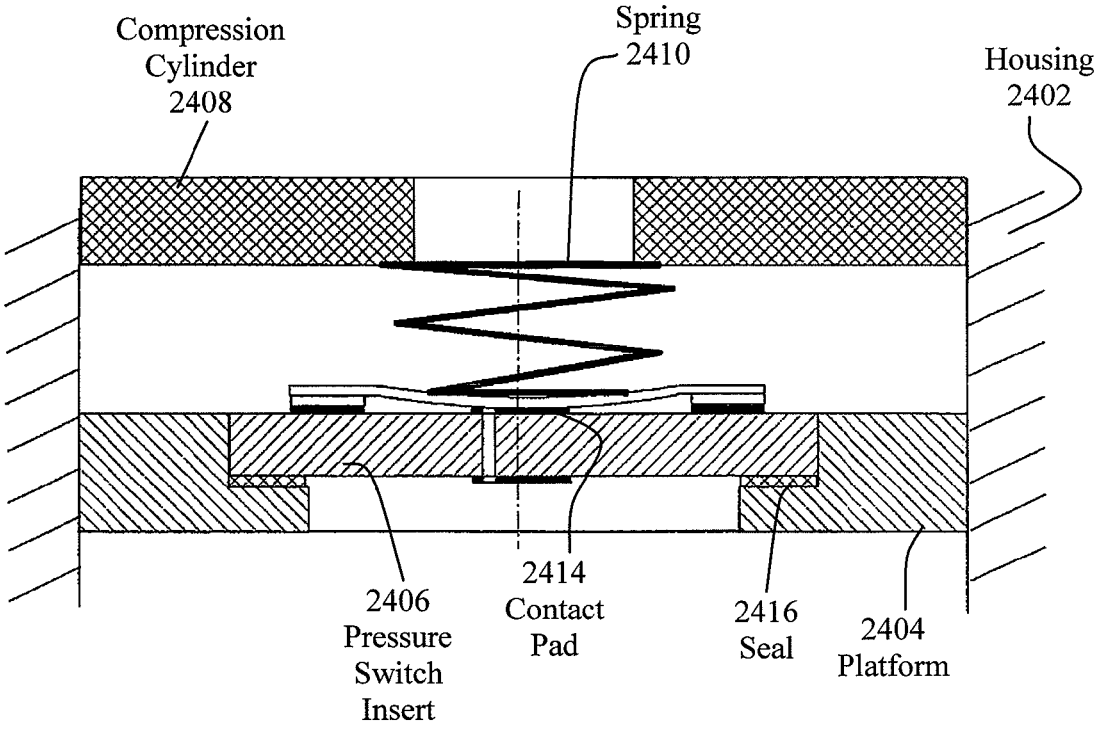
FIG. 24 illustrates another embodiment of a pressure switch.

FIG. 24 is another embodiment of a pressure switch 2400. As shown in FIG. 24, platform 2404 is attached to the housing 2402. Alternatively, platform 2404 can form a portion of the housing 2402. A pressure switch insert 2406 is placed on a recessed portion of the platform 2404 over a seal 2316. Seal 2316 functions as a backup seal to seal the pressure switch insert 2406 to the platform 2404. Spring 2410 is mounted between a compression cylinder 2408 and the dome 2412. Spring 2410 provides a preloading force between the dome 2412 and the contact pad 2414. The compression cylinder 2408 can be moved within the housing 2402 to adjust the preloading force that the spring 2410 applies to the dome 2412. The preloading force between the dome 2412 and the contact pad 2414 ensures that a solid electrical connection is made between the dome 2412 and the contact pad 2414. Seal 2416 provides an additional mechanism for sealing the pressure switch insert 2406 to the platform 2404.

Figure 25:
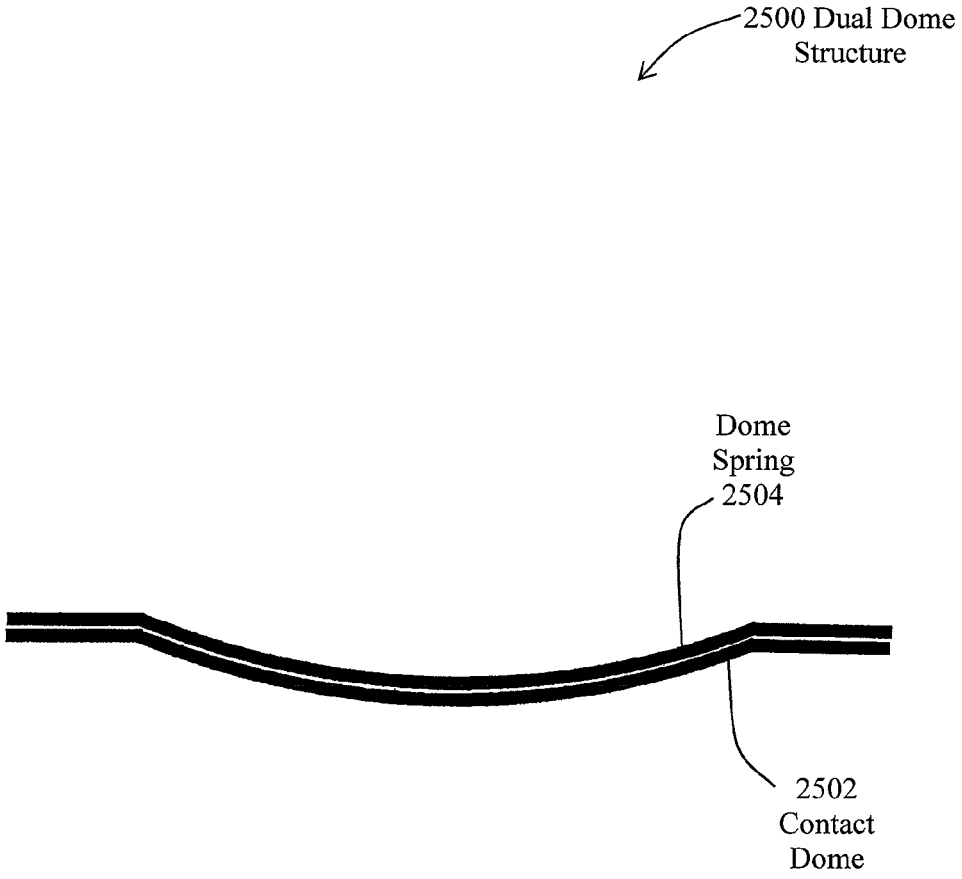
FIG. 25 is a cross-sectional view of an embodiment of a dual dome structure.

FIG. 25 is a cross-sectional view of an embodiment of a dual dome structure 2500. Rather than using a single contact dome, as illustrated in the various embodiments disclosed herein, contact dome 2502 can be assisted by a dome spring 2504. The dome spring 2504 is placed inside the contact dome 2502 and matches the curvature of contact dome 2502. The dome spring 2504 provides an additional force on the contact dome 2502. Depending on the mounting, this force may be a preloading force, which preloads the contact dome 2502 against a contact pad. In this manner, the dome spring 2504 can be designed to create the proper preloading force on the contact dome 2502.

Figure 26:
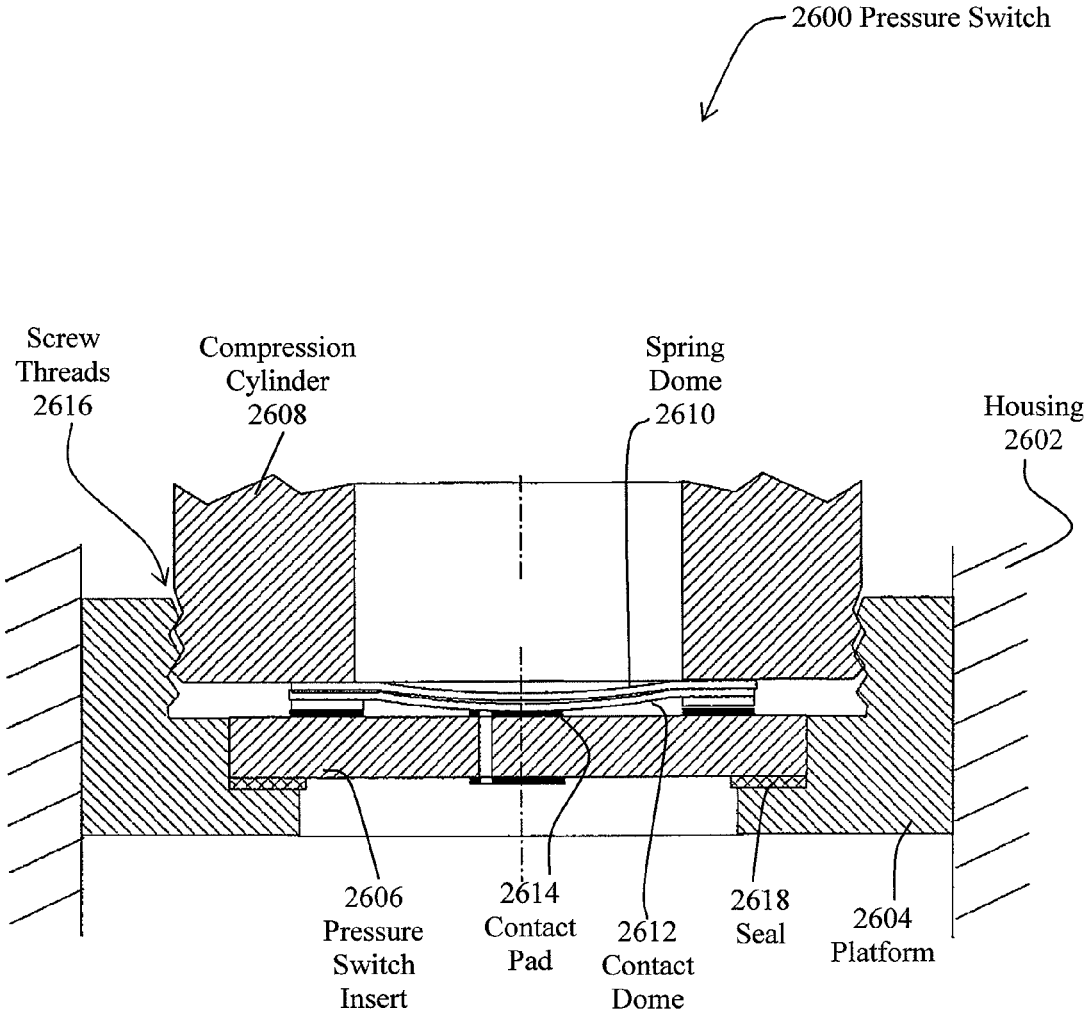
FIG. 26 is a cross-sectional view of another embodiment of a pressure switch.

FIG. 26 is a cross-sectional view of another embodiment of a pressure switch 2600. As illustrated in FIG. 26, platform 2604 is either bonded to, or forms a part of, the housing 2602. Pressure switch insert 2606 fits in a recessed portion of the platform 2604. Seal 2618 provides an additional seal between the pressure switch insert 2606 and the platform 2604. The bonding of the pressure switch insert 2606 to the platform 2604 provides the primary seal between the pressure switch insert 2606 and the platform 2604. Compression cylinder 2608 is threaded onto the platform 2604 by way of threads 2616. As the compression cylinder 2608 is threaded onto the platform 2604, a force is generated on the spring dome 2610, which is transferred to the contact dome 2612 to create a preloading force between the contact dome 2612 and the contact pad 2614. In this manner, the rotation of the compression cylinder 2608 provides an adjustable preloading force between the contact pad 2614 and the contact dome 2612. In addition, the spring dome 2610 and contact dome 2612 can be selected to provide a range of preloading forces that are suitable for any particular desired application.

Figure 27:
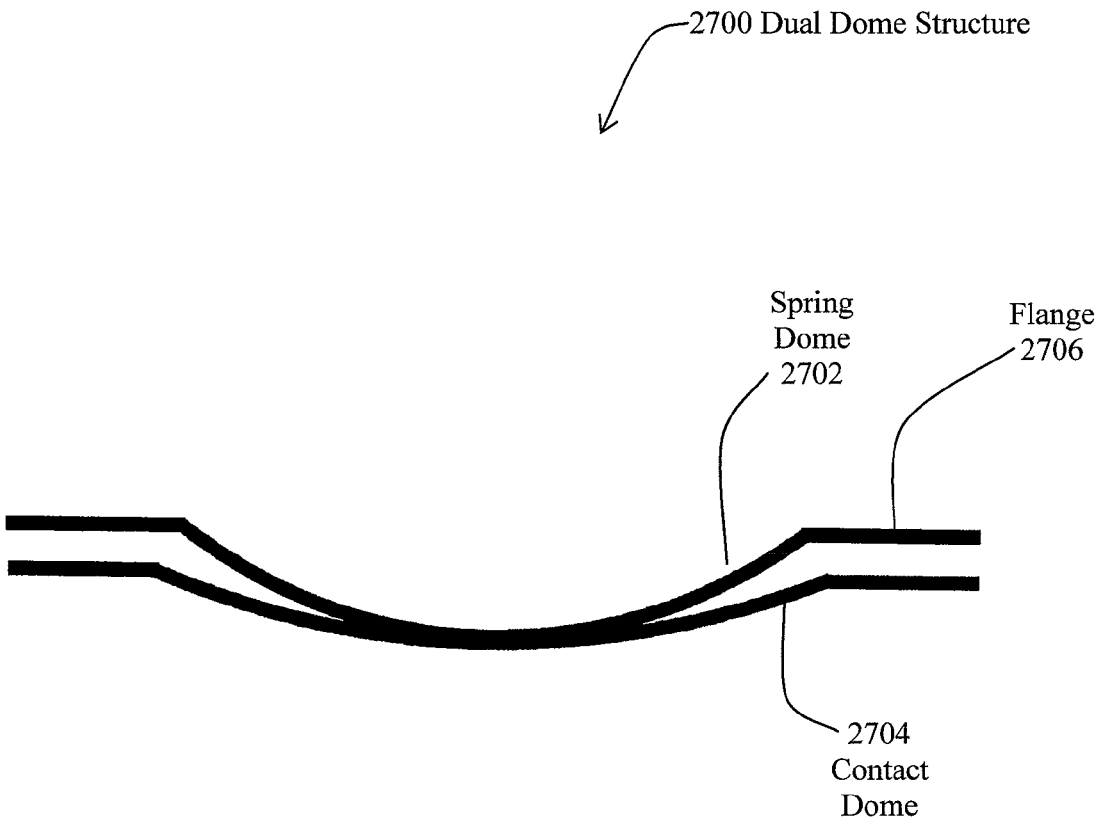
FIG. 27 is a cross-sectional view of another embodiment of a dual dome structure.

FIG. 27 is a cross-sectional view of another embodiment of a dual dome structure 2700. As illustrated in FIG. 27, the spring dome 2702 has a dome curvature that has a smaller radius than the dome curvature of contact dome 2704. As such, spring dome 2702 can exert a preloading force on the contact dome 2704 when a downward force is generated on the flange 2706 of the spring dome 2702. An embodiment for generating the downward force on the flange 2706 is illustrated in FIG. 28.

Figure 28:
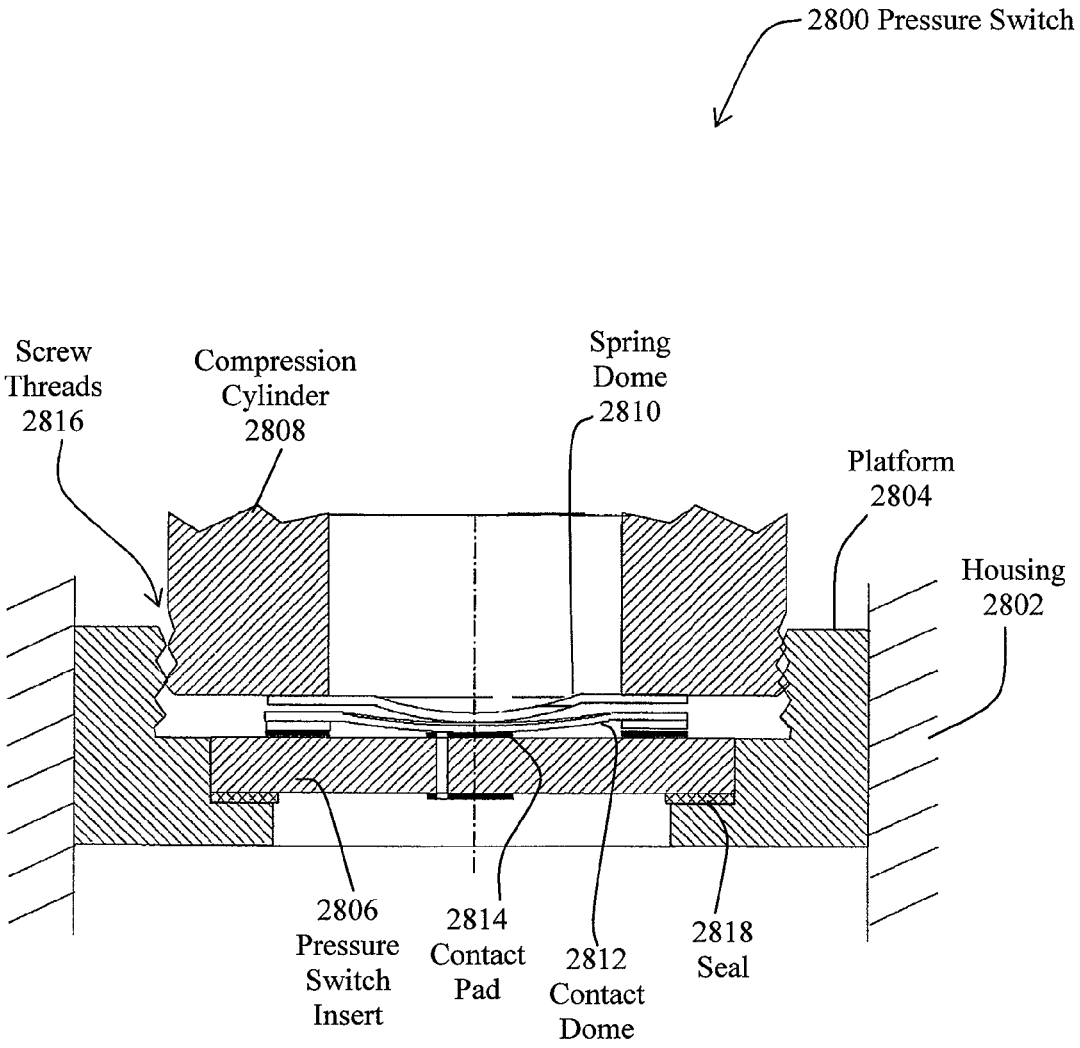
FIG. 28 is another embodiment of a pressure switch that utilizes a spring dome.

FIG. 28 is another embodiment of a pressure switch 2800 that utilizes a spring dome, such as spring dome 2702 illustrated in FIG. 27. As illustrated in FIG. 28, platform 2804 is either attached to, or forms a portion of, the housing 2802. Pressure switch insert 2806 fits within a recess in the platform 2804. Pressure switch insert 2806 is disposed on a seal 2818 that seals the pressure switch insert 2806 to the platform 2804. Seal 2818 is in addition to the seal that is provided by the bonding of the pressure switch insert 2806 to the platform 2804. Compression cylinder 2808 engages the platform 2804 by way of threads 2816. Compression cylinder 2808 generates a downward force, as illustrated in FIG. 28, against the spring dome 2810. Spring dome 2810 has a smaller radius than the contact dome 2812 and, as such, functions as a spring that generates a force against the central portion of the contact dome 2812. The amount of this force can be adjusted by rotating the compression cylinder 2808 in the threads 2816. The spring dome 2810 generates a force on the contact dome 2812, which comprises an adjustable preloading force between the contact dome 2812 and the contact pad 2814.

Accordingly, various embodiments disclosed herein provide for both hysteresis and either preset or adjustable preloading forces. In this manner, the various embodiments of the pressure switches can be designed and utilized for various applications.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A pressure switch comprising:

a substrate;

a contact pad disposed on a first side of said substrate, said contact pad having a first predetermined shape;

a dome switch comprising a dome having a predetermined diameter and a flange surrounding said dome, said flange anchored to said first side of said substrate with said dome pressed against said contact pad with a predetermined preload force that is sufficient to establish an electrical connection between said contact pad and said dome, said flange being anchored to said substrate so that an airtight seal is formed between said flange and said substrate and so that said predetermined diameter of said dome is substantially maintained during deflection of said dome, which substantially removes hysteresis caused by movement of said dome and causes said dome to move substantially elastically during deflection of said dome, said dome having a second predetermined shape that interfaces with said first predetermined shape of said contact pad;

at least one passageway formed in said substrate that allows a pressurized medium on said second side of said substrate to flow through said substrate to said first side of said substrate which causes said dome to depress and separate from said contact pad and electrically disconnect from said contact pad whenever said pressurized medium is greater than a first predetermined pressure, and causes said dome to expand and electrically connect to said contact pad whenever said pressurized medium is less than a smaller second predetermined pressure.

2. The pressure switch of claim 1 wherein said pressure medium is air.

3. The pressure switch of claim 1 wherein said pressure medium is a fluid.

4. The pressure switch of claim 1 wherein said substrate is a printed circuit board.

5. The pressure switch of claim 1 wherein said first predetermined shape and said second predetermined shape are flat surfaces, so that at least a portion of said dome is masked by said contact pad to introduce hysteresis.

6. The pressure switch of claim 1 wherein said first predetermined shape and said second predetermined shape are curved surfaces, so that at least a portion of said dome is masked by said contact pad to introduce hysteresis.

7. The pressure switch of claim 1 wherein said first predetermined shape and said second predetermined shape are different.

8. A pressure switch comprising:

a housing;

a platform disposed in said housing;

a pressure switch substrate that is inserted in said platform that divides a first compartment from a second compartment, said second compartment having a pressurized medium;

a contact pad disposed on said pressure switch substrate;

a dome having a flange that is mounted on said pressure switch substrate, said dome mounted on said pressure switch substrate so that said dome abuts against said contact pad with a preloading force, said dome having a concave side that communicates with said first compartment;

an annulus disposed in said housing that generates a force on said flange to create at least a portion of said preloading force;

at least one passageway formed in said pressure switch substrate that allows said pressurized medium in said second compartment to flow through said pressure switch substrate to communicate with a convex side of said dome that causes said convex side of said dome to depress so that said dome separates from said contact pad and electrically disconnects from said contact pad whenever said pressurized medium is greater than a predetermined pressure, and allows said dome to expand and electrically connect to said contact pad whenever said pressurized medium is less than a smaller second predetermined pressure.

9. The pressure switch of claim 8 wherein said contact pad has a shape that masks a portion of said dome while said dome abuts against said contact pad to create hysteresis during said deflection and expansion of said dome.

10. The pressure switch of claim 7 further comprising:

screw threads formed on said platform and said annulus that allow said annulus to be adjusted so that said force on said flange can be adjusted to adjust said preloading force between said dome and said contact pad.

11. The pressure switch of claim 9 further comprising:

a seal disposed between said annulus and said flange that seals said first compartment from said second compartment.

12. A method of forming a pressure switch comprising:

providing a pressure switch insert comprising a substrate, a dome having a flange that surrounds said dome and a contact pad;

mounting said contact pad on said substrate:

mounting said dome on said substrate so that a convex portion of said dome contacts said contact pad;

providing at least one passageway in said substrate that allows a pressurized medium on a first side of said substrate to flow through said substrate and communicate with said convex portion of said dome that causes said convex side of said dome to depress whenever said pressurized medium is greater than a predetermined pressure which cause said dome to separate from said contact pad and electrically disconnect from said contact pad, and allows said dome to expand and electrically connect to said contact pad whenever said pressurized medium is less than another smaller predetermined pressure;

mounting said pressure switch insert on a platform in a pressure switch housing;

forcing said dome against said contact pad with a preload force that is sufficient to establish an electrical connection between said contact pad and said dome using a compression cylinder that generates a force on said flange.

13. The method of claim 11 further comprising:

adjusting said compression cylinder in said pressure switch housing to adjust said force on said flange.

14. The method of claim 12 wherein said process of adjusting said compression cylinder comprises:

turning said compression cylinder on screw threads formed on said platform and said compression cylinder to adjust said force on said flange.

15. The method of claim 12 wherein said process of adjusting said compression cylinder comprises:

forcing said compression cylinder into a position on said housing and securing said compression cylinder to said housing.

16. The method of claim 11 wherein said pressure switch detects air pressure.

17. The method of claim 11 wherein said pressure switch detects pressure of a fluid.

18. The method of claim 11 wherein said process of providing a pressure switch insert further comprises:

providing a pressure switch insert comprising a contact pad that masks a portion of said dome while said dome abuts against said contact pad to create hysteresis during deflection and expansion of said dome.

* * * * *